US010301763B2

(12) United States Patent
Kim et al.

(10) Patent No.: US 10,301,763 B2
(45) Date of Patent: May 28, 2019

(54) WASHING MACHINE AND METHOD OF CONTROLLING THE SAME

(71) Applicant: SAMSUNG ELECTRONICS CO., LTD., Suwon-si, Gyeonggi-do (KR)

(72) Inventors: Chang Hoo Kim, Suwon (KR); Dong-Il Back, Hwaseong (KR); Min-Hyung Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 65 days.

(21) Appl. No.: 15/086,529

(22) Filed: Mar. 31, 2016

(65) Prior Publication Data

US 2016/0289884 A1 Oct. 6, 2016

(30) Foreign Application Priority Data

Mar. 31, 2015 (KR) ..... 10-2015-0044865

(51) Int. Cl.

| | |
|---|---|
| ***D06F 39/08*** | (2006.01) |
| ***D06F 35/00*** | (2006.01) |
| ***D06F 31/00*** | (2006.01) |
| *D06F 23/04* | (2006.01) |
| *D06F 33/02* | (2006.01) |

(52) U.S. Cl.

CPC ..... *D06F 39/088* (2013.01); *D06F 31/00* (2013.01); *D06F 35/006* (2013.01); *D06F 23/04* (2013.01); *D06F 33/02* (2013.01); *D06F 2202/04* (2013.01); *D06F 2204/088* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,026,699 | A | 3/1962 | Rhodes | |
| 3,209,560 | A | 10/1965 | Shelton | |
| 3,575,020 | A * | 4/1971 | Hubbard | G06F 13/00 68/12.19 |
| 4,978,058 | A * | 12/1990 | Duncan | D06F 39/088 236/12.12 |
| 5,048,139 | A | 9/1991 | Matsumi | |
| 5,460,018 | A * | 10/1995 | Werner | D06F 23/04 475/163 |
| 5,868,311 | A | 2/1999 | Cretu-Petra | |
| 7,313,932 | B2 | 1/2008 | Ryohke | |
| 9,249,536 | B2 * | 2/2016 | Kim | D06F 39/08 |
| 2003/0213850 | A1 | 11/2003 | Mayer | |

(Continued)

FOREIGN PATENT DOCUMENTS

| | | |
|---|---|---|
| CN | 1294318 C | 1/2007 |
| CN | 1990940 A | 7/2007 |

(Continued)

*Primary Examiner* — Jason Y Ko
*Assistant Examiner* — Cristi J Tate-Sims
(74) *Attorney, Agent, or Firm* — Staas & Halsey LLP

(57) ABSTRACT

Provided is a washing machine that includes a body which includes an opening, an auxiliary washing unit which forms a washing space with an open top when being mounted on the body, a water supply apparatus which supplies warm water to the washing space, and a control unit which controls distribution of cold water and hot water of the water supply apparatus to supply the warm water to the washing space.

9 Claims, 38 Drawing Sheets

(56) References Cited

U.S. PATENT DOCUMENTS

| | | | | |
|---|---|---|---|---|
| 2008/0308643 | A1* | 12/2008 | Larson | D06F 33/02 236/12.1 |
| 2009/0019896 | A1* | 1/2009 | Kim | D06F 37/145 68/17 R |
| 2015/0292138 | A1* | 10/2015 | Leonard | D06F 39/088 8/137 |

FOREIGN PATENT DOCUMENTS

| | | | |
|---|---|---|---|
| CN | 101092791 | A | 12/2007 |
| CN | 101195958 | A | 6/2008 |
| CN | 101397744 | A | 4/2009 |
| EP | 1 369 524 | A1 | 12/2003 |
| EP | 1 930 493 | A1 | 6/2008 |
| JP | 58-8484 | | 1/1983 |
| JP | 61-170497 | | 10/1986 |
| JP | 7-20186 | | 4/1995 |
| KR | 1995-0025138 | | 9/1995 |
| KR | 1997-0001664 | | 1/1997 |
| KR | 1997-0015854 | | 4/1997 |
| KR | 1999-0075790 | | 10/1999 |
| KR | 2000-0045026 | | 7/2000 |
| KR | 10-2001-0020106 | | 3/2001 |
| KR | 2002-0008454 | | 1/2002 |
| KR | 2003-0044491 | | 6/2003 |
| KR | 2003-0060572 | | 7/2003 |
| KR | 10-2005-0037059 | | 4/2005 |
| KR | 10-2010-0068882 | | 6/2010 |

* cited by examiner

WASHING MACHINE AND METHOD OF CONTROLLING THE SAME

CROSS-REFERENCE TO RELATED APPLICATION

This application claims the priority benefit of Korean Patent Application No. 10-2015-0044865, filed on Mar. 31, 2015 in the Korean Intellectual Property Office, the disclosure of which is incorporated herein by reference.

BACKGROUND

1. Field

Embodiments of the present disclosure relate to a washing machine capable of performing auxiliary washing and a method of controlling the same.

2. Description of the Related Art

Generally, a washing machine (for example, a fully automatic washing machine) is an apparatus which removes pollutant of laundry using surface activity between water current and detergent and may include a fixed tub for storing water (washing water or rinsing water), a rotating tub rotatably installed in the fixed tub to accommodate laundry, a pulsator rotatably installed in the rotating tub to generate water current, and a driving unit which generates a driving force to rotate the rotating tub and the pulsator.

A washing machine described above performs washing through a series of operations including a washing operation for separating pollutants of laundry using water in which a detergent is dissolved, specifically the washing water, a rinsing operation for rinsing bubbles or a residual detergent from the laundry using water that contains no detergent, specifically, the rinsing water, a spin-drying operation for removing water in the laundry by spinning at a high speed, etc.

Laundry is classified into a type capable of being washed by a full washing cycle which includes the washing operation, rinsing operation, spin-drying operation, etc., a type capable of being washed only by hand-washing such as socks with ingrained dirt, white clothes, underclothes, etc., and a type that is hand-washed according to a user's preference.

Such hand-washing has been performed at a location separate from a washing machine. However, for the purposes of reducing water consumption, user convenience, and the like, there is a need for a user to perform the hand-washing in the space in which the washing machine is located.

SUMMARY

Therefore, it is an aspect of the present disclosure to provide a washing machine capable of performing auxiliary washing and a method of controlling the same.

Additional aspects of the present disclosure will be set forth in part in the description which follows and, in part, will be obvious from the description or may be learned by practice of the present disclosure.

In accordance with one aspect of the present disclosure, a washing machine includes a body which includes an opening, an auxiliary washing unit which forms a washing space with an open top when mounted on the body, a water supply apparatus which supplies warm water to the washing space, and a control unit which controls distribution of cold water and hot water by the water supply apparatus to supply the warm water to the washing space.

The water supply apparatus may include a hot water distributing device which distributes hot water which flows in from the outside and a cold water distributing device which distributes cold water which flows in from the outside.

The water supply apparatus may further include a mixing device which generates the warm water by mixing the hot water distributed by the hot water distributing device with the cold water distributed by the cold water distributing device.

The water supply apparatus may further include a supply device which supplies the warm water generated by the mixing device to the washing space.

The water supply apparatus may further include a temperature sensor for measuring a temperature of the warm water generated by the mixing device to the washing space.

The control unit may stop supplying the hot water when a temperature of the warm water supplied to the washing space is a preset first critical temperature or higher. Also, the control unit may resume supplying the hot water to the washing space when the temperature of the warm water supplied to the washing space is a preset second critical temperature or lower.

The control unit may control a temperature of warm water to be supplied to the washing space by controlling hot water distribution by the hot water distributing device.

The hot water distributing device may include at least one hot water valve for distributing the hot water, and the control unit may control the temperature of the warm water by controlling opening and closing of the hot water distributing device.

The hot water distributing device may include at least one proportional control valve for distributing the hot water, and the control unit may control the temperature of the warm water by controlling an opening degree of the proportional control valve.

The control unit may control a temperature of warm water to be supplied to the washing space by controlling cold water distribution of the cold water distributing device.

In accordance with another embodiment of the present disclosure, a washing machine includes a body which includes a first washing space, an auxiliary washing unit which includes a second washing space formed therein, separated from the first washing space, a water supply apparatus which separately supplies warm water to the first washing space and the second washing space, and a control unit which controls distribution of cold water and hot water of the water supply apparatus to supply the warm water.

The water supply apparatus may include a hot water distributing device which distributes hot water which flows in from the outside to at least one of the first washing space and the second washing space and a cold water distributing device which distributes cold water which flows in from the outside to at least one of the first washing space and the second washing space.

The water supply apparatus may further include a mixing device which generates the warm water by mixing the hot water distributed to the second washing space with the cold water distributed to the second washing space.

The water supply apparatus may further include a supply device which distributes the warm water generated by the mixing device to the second washing space.

A temperature of the warm water supplied to the first washing space may be different from a temperature of the warm water supplied to the second washing space.

The control unit may control hot water distribution of the hot water distributing device or cold water distribution of the cold water distributing device to supply warm water within a preset critical temperature range to the second washing space.

In accordance with still another embodiment of the present disclosure, a method of controlling a washing machine which includes a body which includes an opening, an auxiliary washing unit which forms a washing space with an open top when mounted on the body, and a water supply apparatus which supplies warm water to the washing space includes distributing hot water which flows in from the outside, distributing cold water which flows in from the outside, generating warm water by mixing the distributed hot water with the distributed cold water, and supplying the generated warm water to the washing space.

The method may include detecting a temperature of the warm water to be supplied to the washing space and controlling at least one of distribution of the hot water and distribution of the cold water to generate warm water within a preset temperature range.

The controlling of the distribution may include shutting off the hot water distribution when the detected temperature of the warm water is higher than a first critical temperature and resuming the hot water distribution when the detected temperature of the warm water is lower than a second critical temperature.

BRIEF DESCRIPTION OF THE DRAWINGS

These and/or other aspects of the present disclosure will become apparent and more readily appreciated from the following description of the embodiments, taken in conjunction with the accompanying drawings of which:

FIG. 30 is a flowchart illustrating controlling of warm water supply of the washing machine in accordance with one embodiment of the present disclosure;

DETAILED DESCRIPTION

Hereinafter, a washing machine and a method of controlling the same will be described in detail with reference to the attached drawings.

Figure 1:
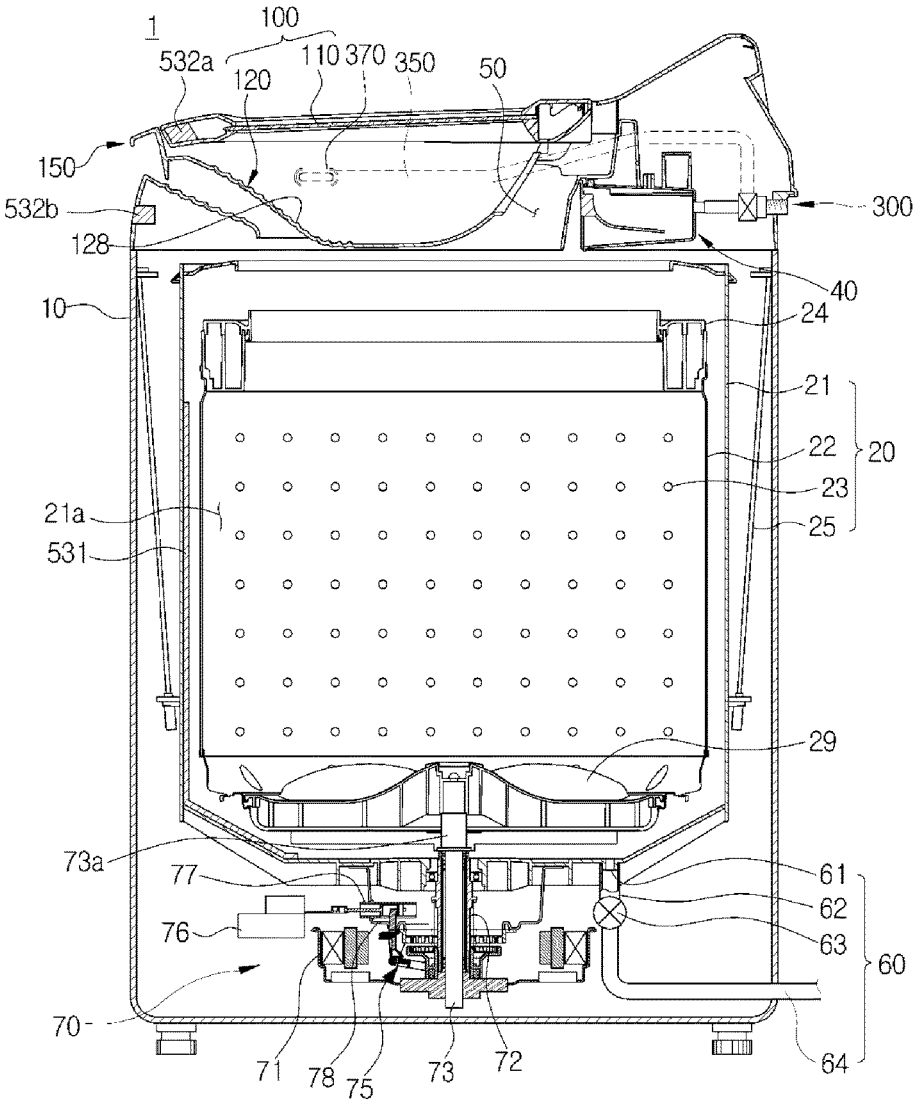
FIG. 1 is a cross-sectional view of a washing machine in accordance with one embodiment of the present disclosure.

FIG. 1 is a cross-sectional view of a washing machine in accordance with one embodiment of the present disclosure.

As shown in FIG. 1, a washing machine 1 may include a body 10, a main washing unit 20 which performs main washing, a drainage portion 60 which discharges washing water used for washing, a driving portion 70 which drives the main washing unit 20, a door assembly 100 able to perform auxiliary washing, and a water supply apparatus 300 which supplies washing water.

Hereinafter, the washing water indicates water supplied through the water supply apparatus 300 and may be classified into hot water, cold water, and warm water depending on a temperature thereof. Also, the washing water may include a detergent supplied for washing.

Also, the washing water may be replaced by another term depending on the operation of the washing machine 1. For example, the washing water may be referred to as washing water during a washing operation for washing laundry and may be referred to as rinsing water during a rinsing operation.

An opening 50 for inserting laundry into the main washing unit 20 is formed at an upper portion of the body 10. The opening 50 may be opened and closed by the door assembly 100 installed above the body 10.

The main washing unit 20 is an apparatus for performing the main washing and may include a fixed tub 21, a rotating tub 22, a balancer 24, a pulsator 29, and a suspension system 25.

The fixed tub 21 may be provided in the body 10 in a shape having an open top and may accommodate washing water. The fixed tub 21 may be supported by the body 10 due to the suspension system 25.

Also, the fixed tub 21 may have an approximately circular shape but the shape of the fixed tub 21 is not limited thereto. The rotating tub 22 may be provided in the fixed tub 21.

The rotating tub 22 is provided in the fixed tub 21. The rotating tub 22 may have a cylindrical shape with an open top to accommodate washing water for washing therein. A plurality of spin-drying holes 13 are provided at a side surface of the rotating tub 22. Due to the plurality of spin-drying holes 23, an inner space of the rotating tub 22 and an inner space of the fixed tub 21 are mutually connected.

That is, a main washing space 21*a* in which the main washing is performed may be formed by the fixed tub 21 and the rotating tub 22, and laundry may be mainly washed in the main washing space 21*a*.

The balancer 24 is provided above the rotating tub 22 and compensates for an unbalanced weight occurring in the rotating tub 22 during rotation at a high speed to allow the rotating tub 22 to stably rotate.

The pulsator 29 is provided below the rotating tub 22 and rotates forward and backward to generate water currents. Laundry in the rotating tub 22 is agitated by the water currents generated by the pulsator 29 and washed.

The drainage portion 60 is an apparatus for discharging washing water in the washing machine 1 to the outside and may include a drainage hole 61 and a drainage valve 63.

The drainage hole 61 is provided below the fixed tub 21, for example, at a bottom of the fixed tub 21 and discharges washing water stored in the fixed tub 21 to the outside of the fixed tub 21. A first drainage pipe 62 may be connected to the drainage hole 61 to carry washing water discharged from the drainage hole 61 to the drainage valve 63.

The drainage valve 63 may be connected to the first drainage pipe 62 to control draining. A second drainage pipe 64 which carries washing water to the outside may be installed at the drainage valve 63. That is, when the drainage valve 63 is opened, washing water in the fixed tub 21 may be discharged to the outside of the washing machine 1 through the drainage hole 61, the drainage pipe 62, and the second drainage pipe 64.

Unlike the above, the drainage portion 60 may further include a drainage pump which provides a pressure to the washing water. The drainage pump generates a pressure to discharge washing water stored in the fixed tub 21 to the outside. The discharge of the washing water may be adjusted by controlling driving of the drainage pump.

The driving portion 70 is an apparatus for generating a driving force to perform the main washing and may be provided below the fixed tub 21 but is not limited thereto.

In detail, the driving portion 70 includes a motor 71 which generates a driving force to rotate the rotating tub 22 as well as the pulsator 29 and a power switching apparatus 75 which simultaneously or selectively transfers the driving force generated by the motor 71 to the rotating tub 22 and the pulsator 29.

A hollow spin-drying shaft 72 may be coupled with the rotating tub 22. A washing shaft 73 may be provided in a hollow portion of the spin-drying shaft 72 and may be coupled with the pulsator 29 by a washing shaft coupling portion 73*a*.

The motor 71 may simultaneously or selectively transfer the driving force to the rotating tub 22 and the pulsator 29 depending on an up-and-down operation of the power switching apparatus 75.

The power switching apparatus 75 may include an actuator 76 which generates a driving force for the power switching, a load portion 77 which linearly moves according to an operation of the actuator 76, and a clutch portion 78 which is connected to the load portion 77 and pivots according to an operation of the load portion 77.

The door assembly 100 may be provided in a shape corresponding to the opening 50 provided at the body 10 and may isolate the body 10 from the outside during the main washing to prevent a leak of the washing water. The door assembly 100 may include an auxiliary washing space 120*a* for auxiliary washing. That is, the auxiliary washing space 120*a* is provided separately from the main washing space 21*a*.

The auxiliary washing means washing performed by a user before performing the main washing. For example, the auxiliary washing means hand-washing for a particular soiled part of laundry. Hereinafter, referring to FIGS. 2 to 13, the door assembly will be described in detail.

Figure 2:
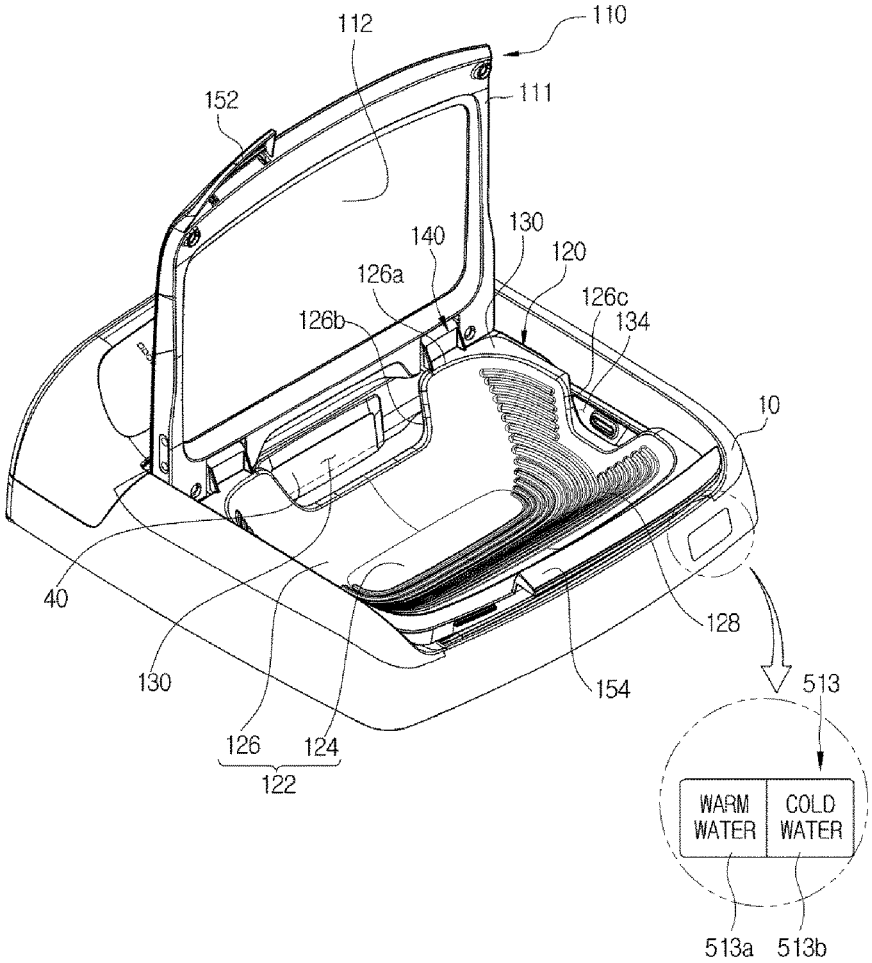
FIG. 2 is a perspective view of the washing machine with a door opened in accordance with one embodiment of the present disclosure.
Figure 3:
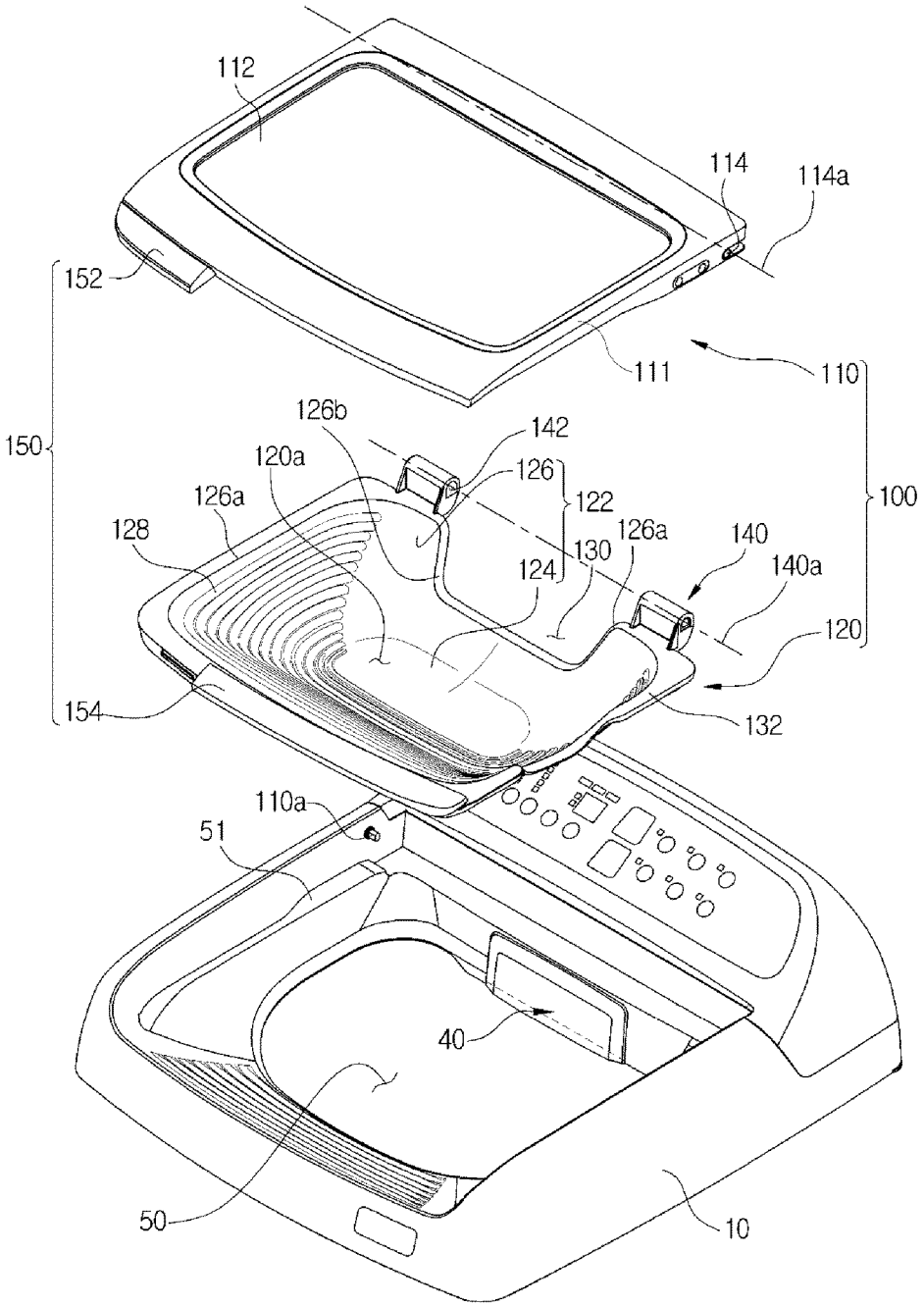
FIG. 3 is an exploded view of a door assembly of the washing machine in accordance with one embodiment of the present disclosure.
Figure 4:
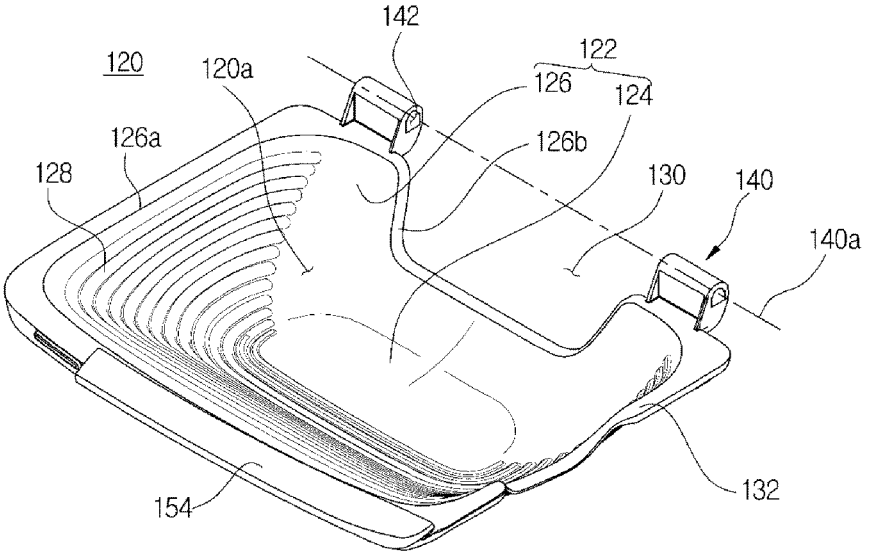
FIG. 4 is a perspective view of an auxiliary washing unit of the washing machine in accordance with one embodiment of the present disclosure.

FIG. 2 is a perspective view of the washing machine with a door opened in accordance with one embodiment of the present disclosure. FIG. 3 is an exploded view of the door assembly of the washing machine in accordance with one embodiment of the present disclosure. FIG. 4 is a perspective view of an auxiliary washing unit 120 of the washing machine in accordance with one embodiment of the present disclosure.

Referring to FIGS. 2 to 4, the door assembly 100 is provided at the opening 50. The door assembly 100 may include a door 110 and the auxiliary washing unit 120.

The door 110 is provided to couple with one side of the body 10 to open and close the opening 50. The door 110 may include a door frame 111 which forms an exterior of the door 110 and a transparent member 112 provided to allow the inside of the door 110 to be shown even when the opening 50 is closed. Here, the transparent member 112 may be provided inside the door frame 111.

The auxiliary washing unit 120 includes the auxiliary washing space 120*a* for auxiliary washing. In the auxiliary washing space 120*a*, auxiliary washing including, for example, hand-washing may be performed.

The auxiliary washing space 120*a* is provided separately from the main washing space 21*a* formed by the fixed tub 21 and the rotating tub 22. As described above, due to the separation between the main washing space 21*a* and the auxiliary washing space 120*a*, the main washing and the auxiliary washing may be performed independently.

That is, washing in the main washing space 21*a* and washing in the auxiliary washing space 120*a* may be separately or simultaneously performed.

The auxiliary washing unit 120 may be provided inside the door 110 to pivot around on one side thereof. The auxiliary washing unit 120 may have a pivot identical to a pivot of the door 110. Pivoting of the auxiliary washing unit 120 and the door 110 will be described below in detail.

The auxiliary washing unit 120 may include a unit body 122, a friction protrusion 128, and an auxiliary drainage hole 130.

The auxiliary washing space 120*a* is formed by the unit body 122. For this, the unit body 122 may include a bottom portion 124 and a side portion 126.

The bottom portion 124 is an element which determines a depth of the auxiliary washing space 120*a*. The bottom portion 124 may be formed flat or curved. The side portion 126 may be formed with a gradient toward the bottom portion 124.

The bottom portion 124 and the side portion 126 are configured to form the auxiliary washing space 120*a* in an approximately concave shape so that the auxiliary washing space 120*a* may receive washing water to perform an auxiliary washing.

The friction protrusion 128 is provided at the unit body 122 to aid the auxiliary washing. The friction protrusion 128 increases a frictional force with the laundry during hand-washing to facilitate removal of the dirt in the laundry.

For this, the friction protrusion 128 is formed on an inside of the auxiliary washing unit 120 to be more convex than an adjacent portion thereof but not limited thereto and may be formed in various shapes for increasing the frictional force with the laundry.

Also, a plurality of the friction protrusions 128 may be formed side by side. However, the shape and arrangement of the friction protrusions 128 are not limited thereto.

The friction protrusions 128 are provided at the side portion 126 in FIGS. 2 to 5 but are not limited thereto and may be provided in various positions inside the unit body 122. For example, the friction protrusions 128 may be provided at the bottom portion 124.

The auxiliary drainage hole 130 is provided to discharge washing water used in the auxiliary washing space 120*a*. The auxiliary drainage hole 130 may be formed as a hole. Also, the auxiliary drainage hole 130 may have an additional opening and closing member and may be disposed at the bottom portion 124 of the auxiliary washing space 120*a*. However, hereinafter, it will be described in relation that the auxiliary drainage hole 130 is provided at the side portion 126 of the unit body 122.

The auxiliary drainage hole 130 is provided to allow washing water stored in the auxiliary washing space 120*a* to be tilted and discharged when the auxiliary washing unit 120 pivots.

The auxiliary drainage hole 130 may be formed by a perimeter 126*b* of the auxiliary drainage hole 130 formed lower than a top end portion 126*a* of the unit body 122 adjacent thereto.

That is, the auxiliary drainage hole 130 may be formed at a portion formed concavely from the top end portion 126*a* of the unit body 122. However, a shape of the auxiliary drainage hole 130 is not limited thereto and may be any shape provided capable of discharging the washing water stored in the auxiliary washing space 120*a* when the auxiliary washing unit 120 is tilted.

The auxiliary washing unit 120 may include a mounting flange 132. The mounting flange 132 is formed in a flange shape at a top end of the auxiliary washing unit 120 along a perimeter thereof. That is, the mounting flange 132 may be provided along the top end of the unit body 122 in a flange shape.

Also, a mounting portion 51 which protrudes along a perimeter of the opening 50 may be provided on an inner surface of the opening 50. The mounting flange 132 may be provided to be mounted on the mounting portion 51. The mounting flange 132 is mounted on the mounting portion 51, and thereby the auxiliary washing unit 120 may be fixed to the body 10.

A cushion member may be provided at a bottom surface of the auxiliary washing unit 120 to cushion an impact during mounting the mounting flange 132 on the mounting portion 51. That is, due to the cushion member, the auxiliary washing unit 120 or the body 10 may be prevented from being damaged, and noise which occurs during mounting may be reduced.

Also, the auxiliary washing unit 120 may be formed of a thermoplastic resin. The auxiliary washing unit 120 may be formed of acrylonitrile, butadiene, and styrene (ABS). In addition, materials having impact resistance and strength necessary for hand-washing may be used as an example of material of the auxiliary washing unit 120.

Figure 5:
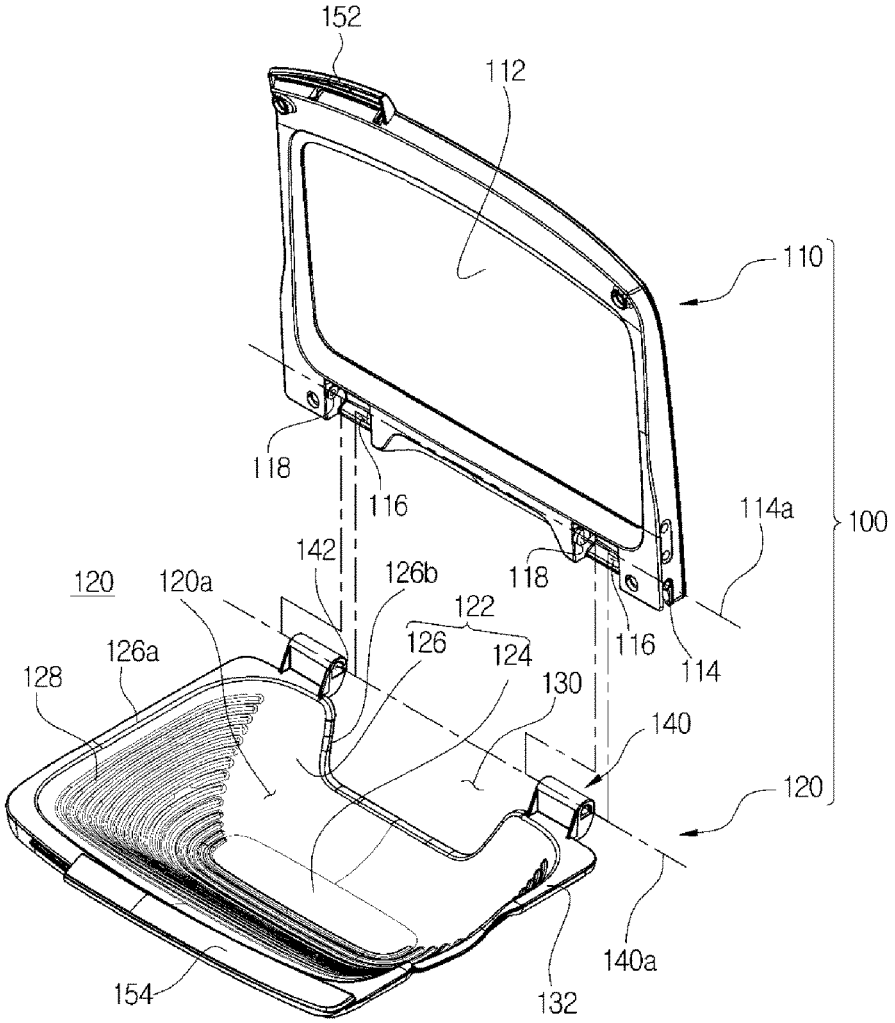
FIG. 5 is a perspective view illustrating coupling of the door assembly of the washing machine in accordance with one embodiment of the present disclosure.
Figure 6:
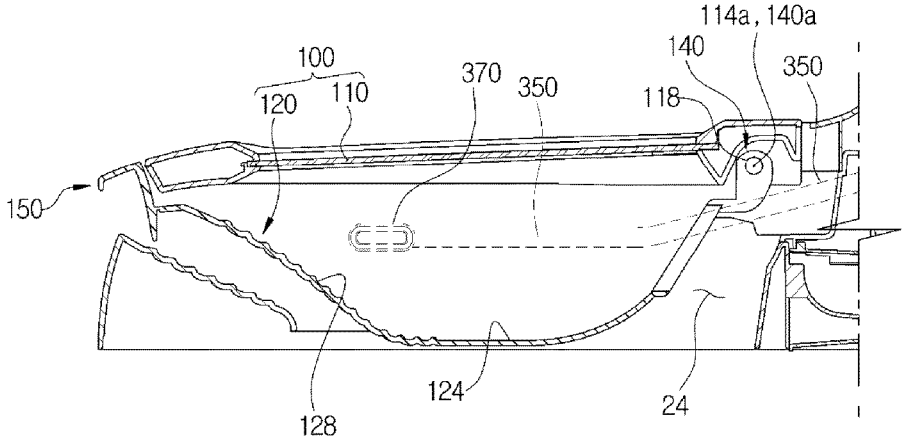
FIG. 6 is a cross-sectional view of the door assembly of the washing machine in accordance with one embodiment of the present disclosure.
Figure 7:
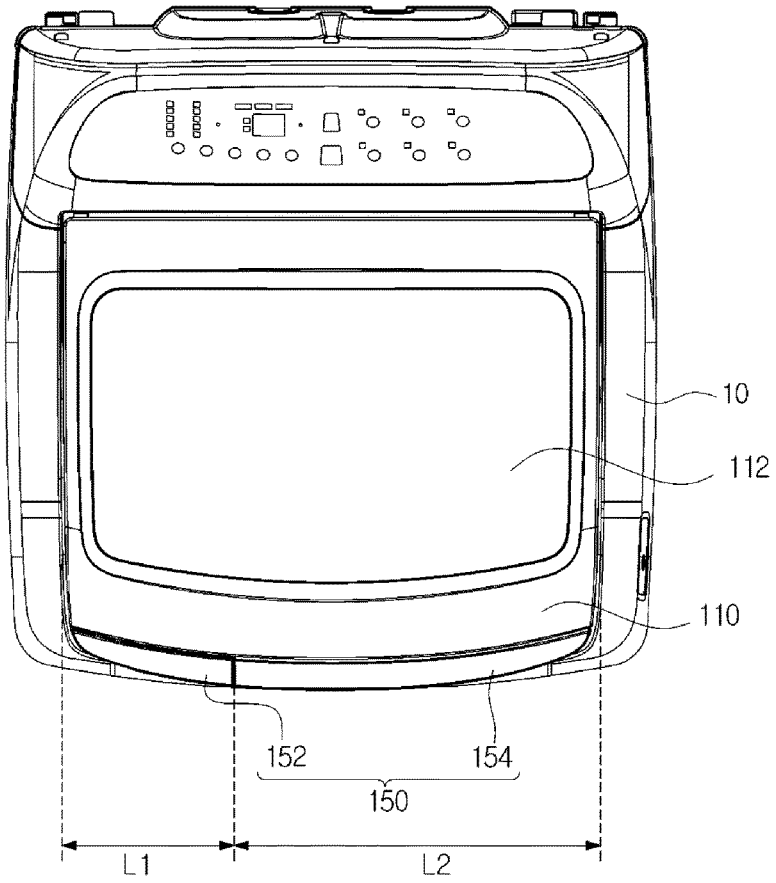
FIG. 7 is a top view of the washing machine in accordance with one embodiment of the present disclosure.

FIG. 5 is a perspective view illustrating coupling of the door assembly of the washing machine in accordance with one embodiment of the present disclosure. FIG. 6 is a cross-sectional view of the washing assembly of the washing machine in accordance with one embodiment of the present disclosure. FIG. 7 is a top view of the washing machine in accordance with one embodiment of the present disclosure.

Referring to FIGS. 2 to 7, the door 110 and the auxiliary washing unit 120 are each provided to be pivotable about the body 10.

The door 110 is provided to be pivotable around a door pivot 114*a*, and the auxiliary washing unit 120 is provided to be pivotable around an auxiliary pivot 140*a*.

The door pivot 114*a* and the auxiliary pivot 140*a* are disposed on the same plane with the door 110 and the auxiliary washing unit 120 to open and close the door 110 and the auxiliary washing unit 120 in the same direction.

For this, the door 110 is pivotably coupled with the body 10 by a door pivoting portion 110*a* provided at the body 10 along the door pivot 114*a*, and the auxiliary washing unit 120 is pivotably coupled with the door 110 by an auxiliary pivoting portion 140.

The door pivoting portion 110*a* may protrude in a protrusion shape from the body 10 toward the door pivot 114*a* to allow the door 110 to pivot around the door pivot 114*a*.

In detail, an accommodating portion 114 is provided at the door 110, and the door pivoting portion 110*a* is inserted into the accommodating portion 114, thereby supporting the door 110 to be pivotable from the body 10.

However, a coupling structure of the door is not limited thereto. For example, the door pivoting portion 110*a* may protrude in a protrusion shape from an outer surface of the door 110 toward the door pivot 114*a* to allow the door 110 to pivot around the door pivot 114*a*.

Also, the shape of the door pivoting portion 110*a* is not limited, and various shapes provided to allow the door 110 to be pivotable from the body 10 may each be used as an example of the shape of the door pivoting portion 110*a*.

To allow the auxiliary pivoting portion 140 to pivot, an insertion portion 116 concavely formed is provided at one side of the door 110. To allow the auxiliary washing unit 120 to pivot around the auxiliary pivot 140*a*, a pivoting protrusion 118 which protrudes toward the auxiliary pivot 140*a* is provided. The pivoting protrusion 118 is coupled with the insertion portion 116.

A pivoting hole 172 may be formed at the auxiliary washing unit 120 corresponding to the pivoting protrusion 118. To allow the door pivot 114*a* to coincide with the auxiliary pivot 140*a*, the auxiliary pivoting portion 140 is provided to be inserted into a part of the door 110 and pivot.

Meanwhile, the auxiliary pivoting portion 140 may be provided in a shape protruding from the unit body 122 to allow the auxiliary pivot 140*a* to be spaced apart from the unit body 122. Due to this structure, a radius of rotation of the auxiliary washing unit 120 may be increased, and the unit body 122 may not be interrupted by the door 110 or the body 10 during a rotation of the auxiliary washing unit 120.

A pivoting shape and arrangement of the door 110 and the auxiliary washing unit 120 are not limited, and each of various shapes or arrangements provided to allow the door 110 and the auxiliary washing unit 120 to open and close the opening 50 may be used as an example of the pivoting shape and arrangement of the door 110 and the auxiliary washing unit 120.

The door assembly 100 may include a handle portion 150.

The handle portion 150 may include a door handle portion 152 provided at the door 110 and an auxiliary handle portion 154 provided at the auxiliary washing unit 120.

Corresponding to the door pivot 114*a* provided at one side, the door handle portion 152 may be provided at the other side of the door 110. In the same manner, corresponding to the auxiliary pivot 140*a* provided at one side, the auxiliary handle portion 154 may be provided at the other side of the auxiliary washing unit 120. The door handle portion 152 and the auxiliary handle portion 154 may be provided parallel in the longitudinal direction.

The door handle portion 152 and the auxiliary handle portion 154 are provided at a front portion of the door 110 and a front portion of the auxiliary washing unit 120 respectively for pivoting the door 110 and the auxiliary washing unit 120. The door 110 may be pivoted by operating the door handle portion 152. Only the auxiliary washing unit 120 may be pivoted, or the auxiliary washing unit 120 and the door 110 may be pivoted together by operating the auxiliary handle portion 154.

The door handle portion 152 may be formed with a first length L1 with respect to the front portion of the door assembly 100, and the auxiliary handle portion 154 may be formed with a second length L2 formed parallel to the first length L1.

When the door handle portion 152 is operated, the door 110 may be pivoted. When the auxiliary handle portion 154 is operated while the door 110 is open, the auxiliary washing unit 120 may be pivoted. When the auxiliary handle portion 154 is operated while the door 110 is closed, since the door 110 and the auxiliary washing unit 120 may be pivoted together, the second length L2 may be longer than the first length L1 considering weights of the door 110 and the auxiliary washing unit 120. That is, the auxiliary handle portion 154 may be longer than the door handle portion 152. Hereinafter, the operation of the door assembly 100 will be described.

Figure 8A:
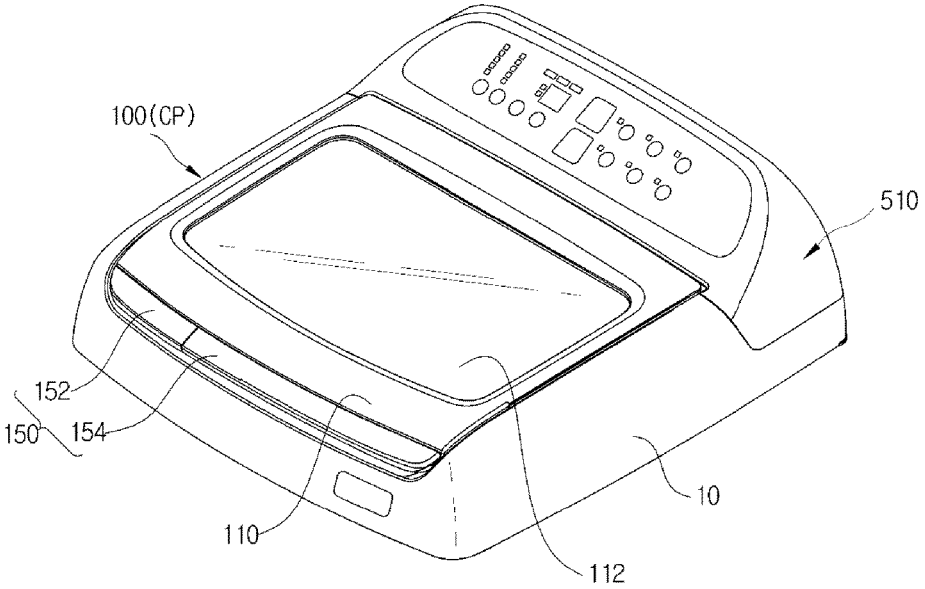
FIGS. 8A, 8B, and 8C are perspective views illustrating operations of the door assembly included in the washing machine in accordance with one embodiment of the present disclosure.
Figure 8B:
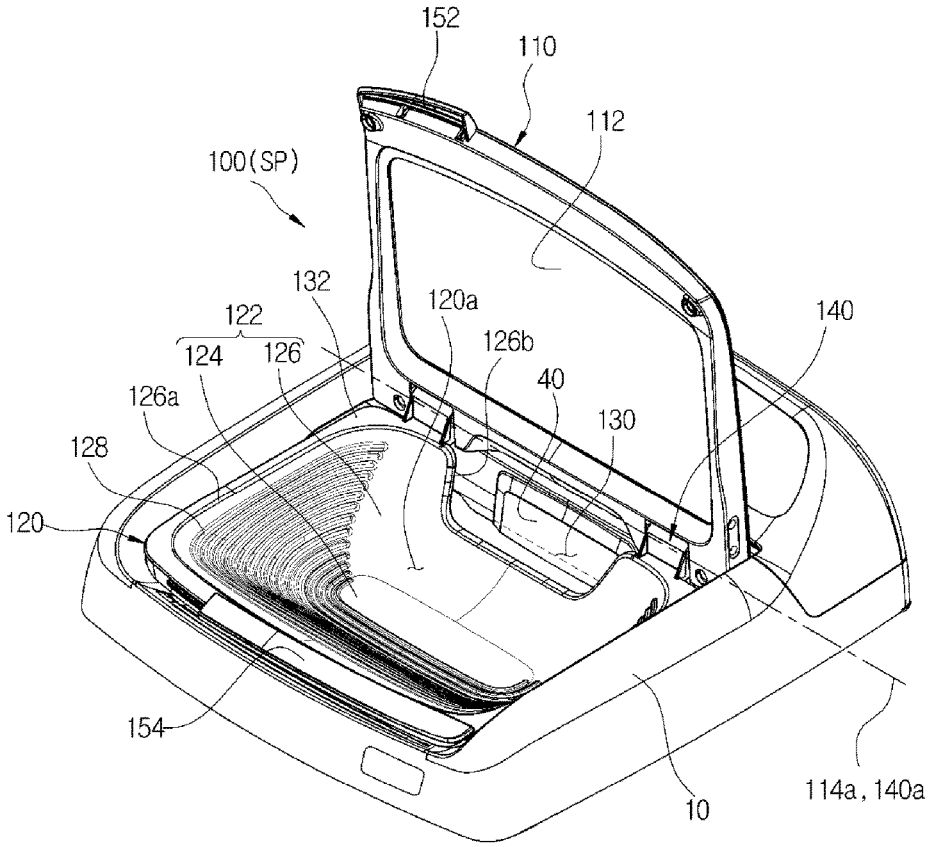
Figure 8C:
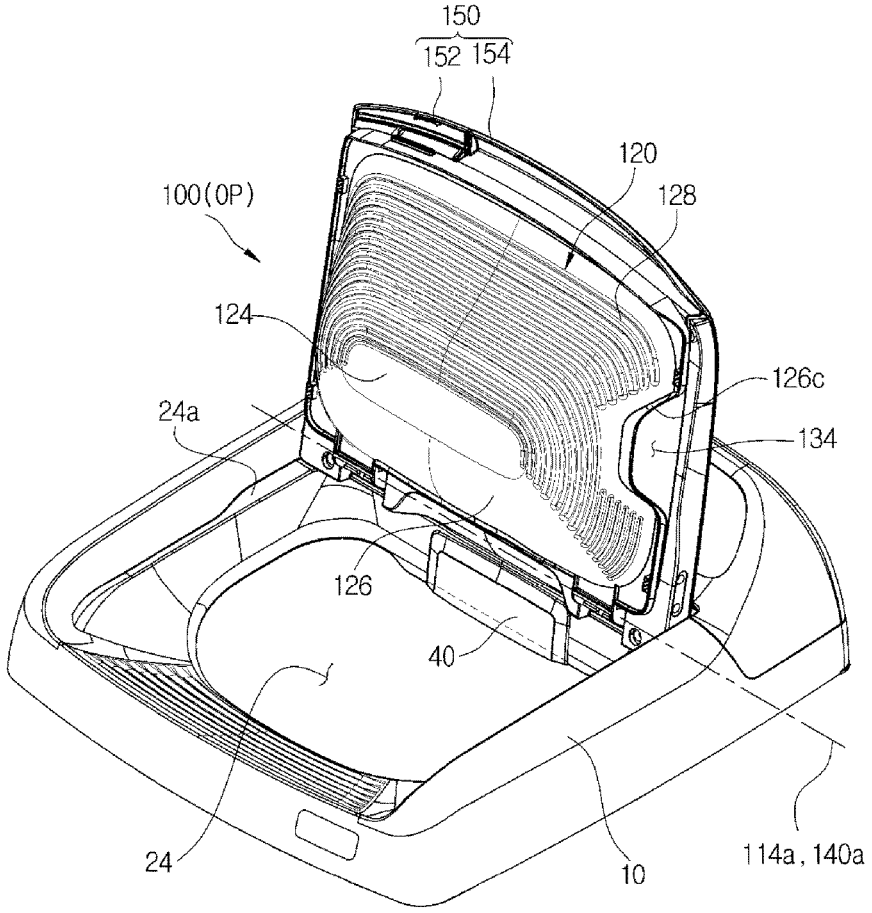
Figure 9A:
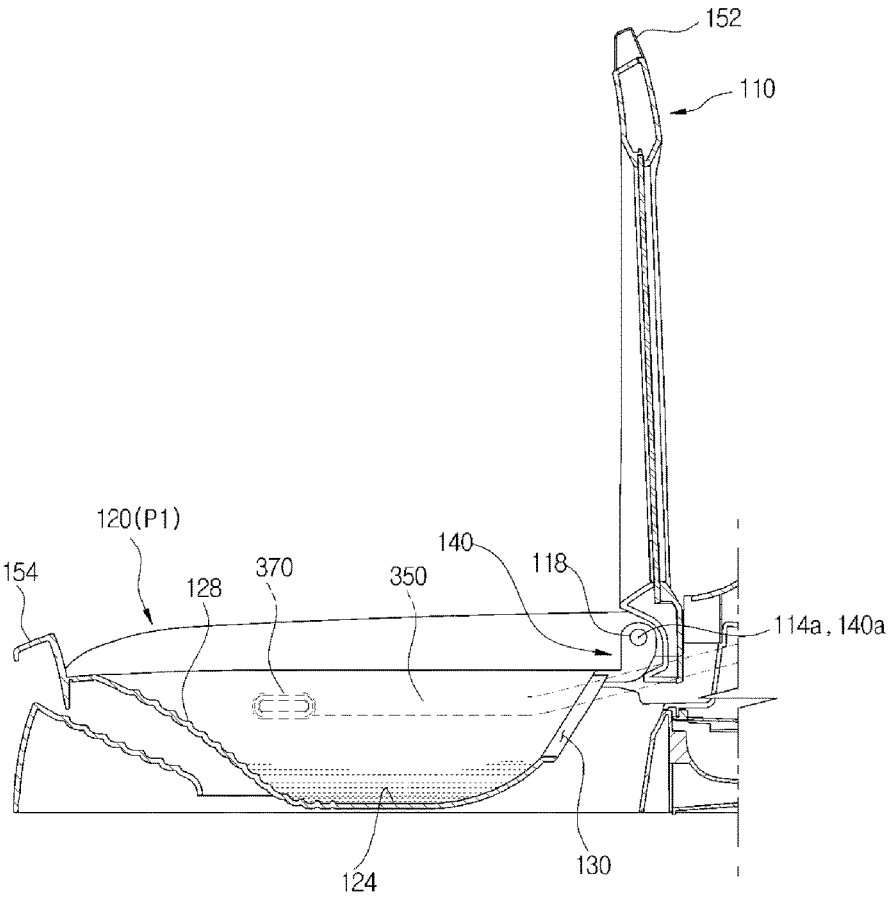
FIGS. 9A and 9B are views illustrating an operation of the auxiliary washing unit.
Figure 9B:
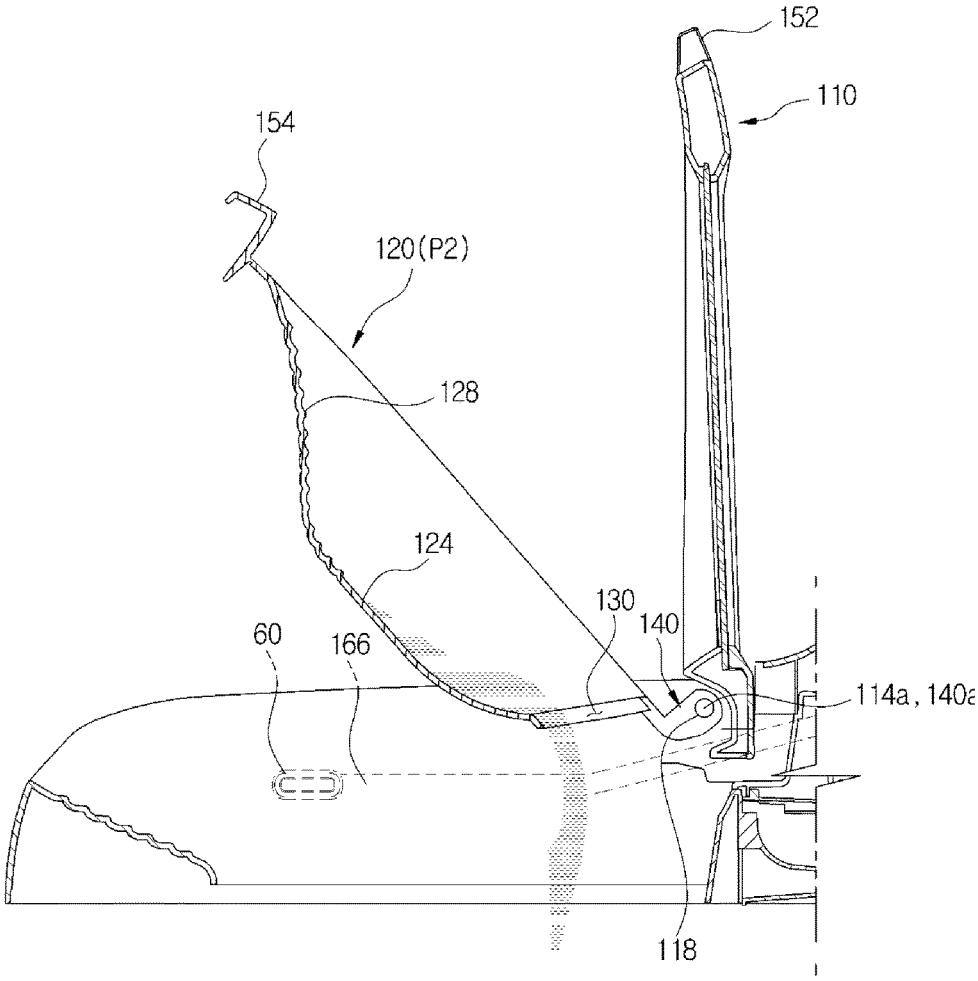

FIGS. 8A, 8B, and 8C are perspective views illustrating operations of the door assembly included in the washing machine in accordance with one embodiment of the present disclosure. FIGS. 9A and 9B are views illustrating an operation of the auxiliary washing unit.

Referring to FIGS. 8A to and 9B, the door assembly 100 is provided to pivot to positions among closed position CP, auxiliary washing position SP, and open position OP.

The closed position CP is a position at which the door 110 and the auxiliary washing unit 120 are disposed at the opening 50 and block the opening 50 to allow the door assembly 100 to close the opening 50.

The auxiliary washing position SP is a position at which the door assembly 100 is disposed to allow the door 110 to pivot from the closed position CP to perform auxiliary washing in the auxiliary washing unit 120.

The open position OP is a position at which the door 110 and the auxiliary washing unit 120 pivot from the closed position CP or the auxiliary washing position SP to allow the door assembly 100 to open the opening 50.

Due to the operation of the door handle portion 152, the door assembly 100 moves between the closed position CP and the auxiliary washing position SP. Due to the operation of the auxiliary handle portion 154, the door assembly 100 moves between the closed position CP and the open position OP.

After the auxiliary washing is completed, while the door assembly 100 is at the auxiliary washing position SP, residual washing water in the auxiliary washing space 120*a* as shown in FIG. 9A is discharged to the main washing space 21*a* or to the outside of the washing machine 1 through the auxiliary drainage hole 130 as shown in FIG. 9B.

In detail, when a position of the auxiliary washing unit 120 while the door assembly 100 is in the auxiliary washing position SP is referred to as a first position P1, the auxiliary washing unit 120 is provided to pivot between the first position P1 and a second position P2 at which the auxiliary washing unit 120 is located to discharge the washing water in the auxiliary washing space 120*a* to the main washing space 21*a* or to the outside of the washing machine 1 through the auxiliary drainage hole 130.

The second position P2 indicates a position at which the auxiliary washing unit 120 pivots around the auxiliary pivot 140*a* and tilts to discharge the washing water in the auxiliary washing space 120*a* through the auxiliary drainage hole 130. The second position P2 may be formed between the first position P1 and a position of the auxiliary washing unit 120 corresponding to when the door assembly 100 is in the open position OP.

Since the auxiliary drainage hole 130 is formed at a portion with a lower height than the adjacent side portion 126, the washing water may be sufficiently discharged through the auxiliary drainage hole 130 by tilting to prevent the washing water from overflowing over the top end of the side portion 126.

Hereinafter, another example of the door assembly 100 will be described. Hereinafter, like reference numerals designate like elements in the above description, and detailed descriptions thereof will be omitted.

Figure 10:
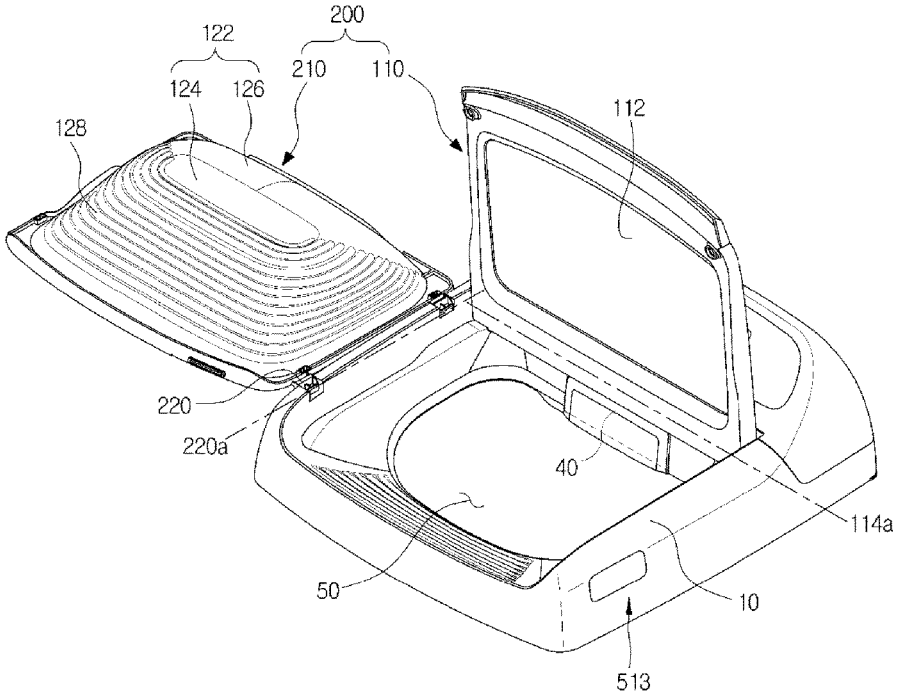
FIG. 10 is a perspective view illustrating coupling of a door assembly in accordance with another embodiment of the present disclosure.
Figure 11:
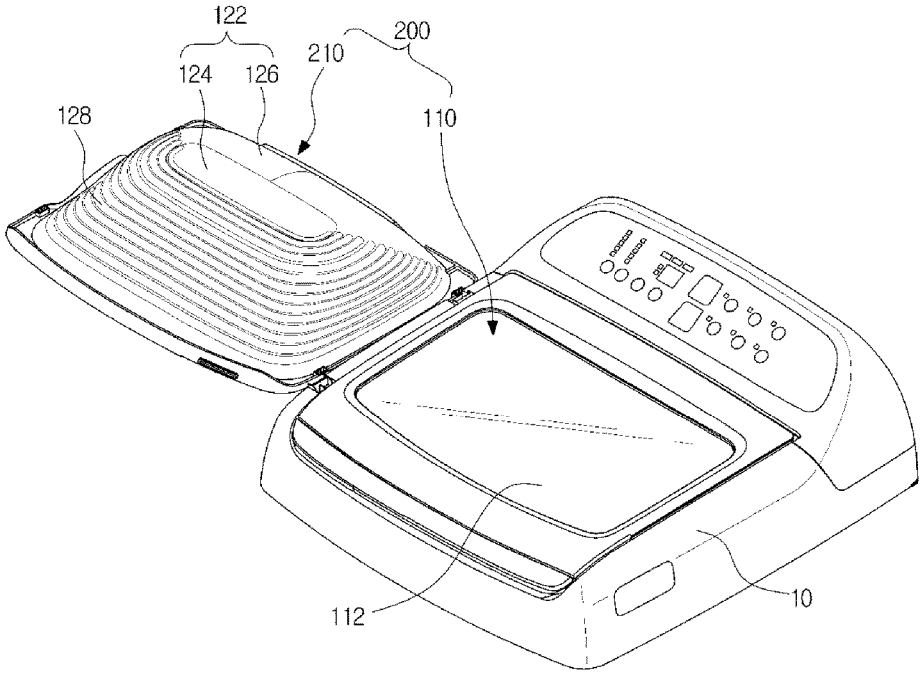
FIG. 11 is a perspective view of the door assembly with a closed door in accordance with another embodiment of the present disclosure.

FIG. 10 is a perspective view illustrating coupling of a door assembly in accordance with another embodiment of the present disclosure. FIG. 11 is a perspective view of the door assembly with a closed door in accordance with another embodiment of the present disclosure.

Figure 12:
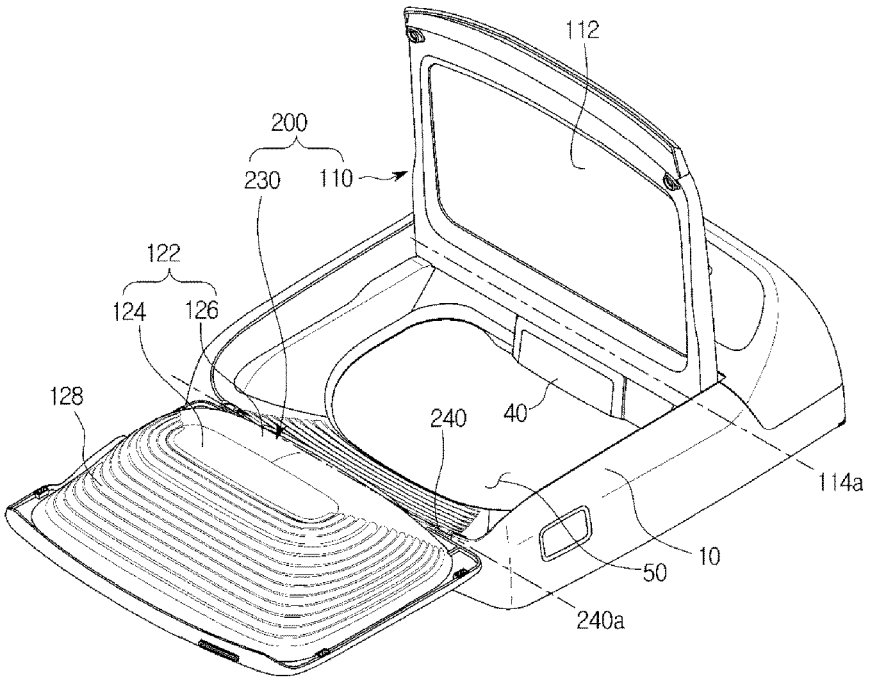
FIG. 12 is a perspective view illustrating coupling of a door assembly in accordance with still another embodiment of the present disclosure.
Figure 13:
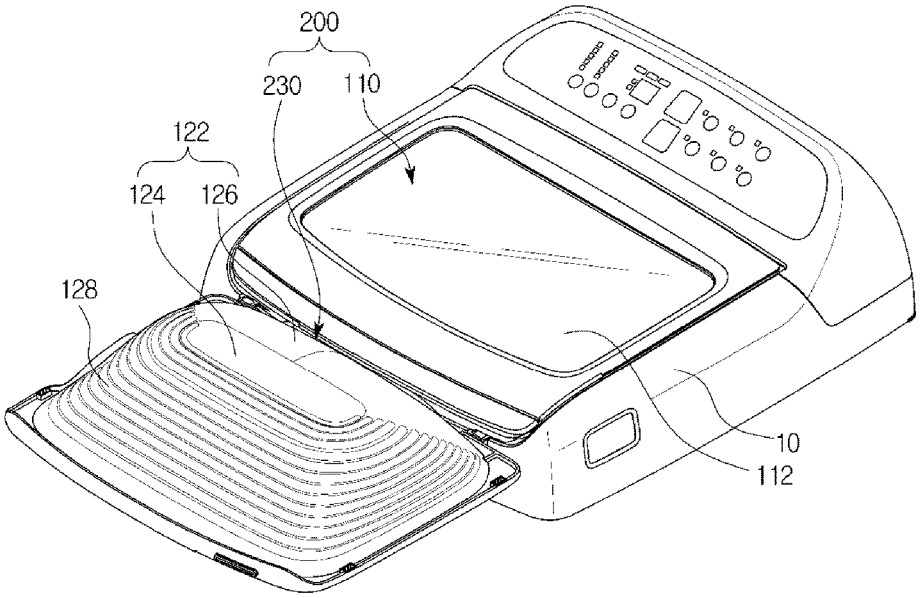
FIG. 13 is a perspective view of the door assembly with a closed door in accordance with still another embodiment of the present disclosure.

FIG. 12 is a perspective view illustrating coupling of the door assembly 100 in accordance with still another embodiment of the present disclosure. FIG. 13 is a perspective view of the door assembly 100 with a closed door in accordance with still another embodiment of the present disclosure.

Referring to FIGS. 10 to 13, a door assembly 200 in accordance with another embodiment of the present disclosure may include the door 110 and auxiliary washing units 210 and 230.

The auxiliary washing units 210 and 230 include the unit body 122 formed of the bottom portion 124 and the side portion 126. Here, the friction protrusion 128 may be provided at the side portion 126.

The door 110 and the auxiliary washing units 210 and 230 may each be provided to be pivotable around the body 10. In detail, the door 110 is provided to be pivotable around the door pivot 114*a*, and the auxiliary washing units 210 and 230 are provided to be pivotable around auxiliary pivots 220*a* and 240*a*.

The door pivot 114*a* and the auxiliary pivots 220*a* and 240*a* may be disposed in different directions at the opening 50. That is, the door 110 and the auxiliary washing units 210 and 230 may each be provided to pivot in different direction.

As an example, the door pivot 114*a* and the auxiliary pivot 220*a*, as shown in FIGS. 10 and 11, are provided to vertically cross each other in such a way that the door 110 pivots forward and backward around the body 10 and the auxiliary washing unit 210 pivots left and right around the body 10.

In detail, the auxiliary washing unit 210 includes an auxiliary pivoting portion 220. The auxiliary pivoting portion 220 may be provided in a shape which protrudes from the unit body 122 to allow the auxiliary pivot 220*a* to be spaced apart from the unit body 122.

Due to this structure, a radius of rotation of the auxiliary washing unit 210 may be increased, and the unit body 122 may not be interrupted by the door 110 or the body 10 during rotation of the auxiliary washing unit 220.

As another example, the door pivot 114*a* and the auxiliary pivot 240*a*, as shown in FIGS. 12 and 13, may be provided to be spaced apart parallel. That is, the door pivot 114*a* and the auxiliary pivot 240*a* are provided to allow the door 110 to pivot forward and backward around a rear portion of the body 10 and the auxiliary washing unit 210 to pivot forward and backward around a front portion of the body 10.

As described above, since pivoting directions of the door 110 and the auxiliary washing units 210 and 220 are different, even when the auxiliary washing units 210 and 220 pivot in a direction of opening the opening 50, it is possible to open and close the door 110 regardless. That is, the auxiliary washing units 210 and 220 as well as the door 110 may be provided to independently pivot.

Referring to FIG. 1 again, the washing machine 1 includes the water supply apparatus 300 for supplying washing water. The water supply apparatus 300 may be provided at an upper portion the washing machine 1. For example, the water supply apparatus 300 may be located behind the door assembly 100.

The water supply apparatus 300 may supply washing water to the main washing unit 20 or the auxiliary washing unit 120. A temperature of the washing water supplied by the water supply apparatus 300 is determined according to a control command of a user. For example, the temperature of the washing water may be determined depending on a washing type input by the user, but the method of determining the washing water temperature is not limited thereto.

The washing water supplied by the water supply apparatus 300 may be classified into hot water, cold water, and warm water. Here, the hot water means water at a higher temperature than the cold water and the warm water, and the cold water indicates water at a low temperature. The warm water means water at a temperature about in the middle of those of the cold water and the hot water and may be generated by mixing the cold water with the hot water. That is, the warm water may be water that is a mixture of the hot water and the cold water.

For example, the warm water may be at a temperature from 20° C. to 40° C., the hot water may be at a temperature higher than 40° C., and the cold water may be at a temperature lower than 20° C.

Also, a temperature of washing water supplied to the main washing unit 20 and a temperature of washing water supplied to the auxiliary washing unit 120 may be different from each other. Hereinafter, the water supply apparatus 300 will be described in detail with reference to FIGS. 14 to 24.

Figure 14:
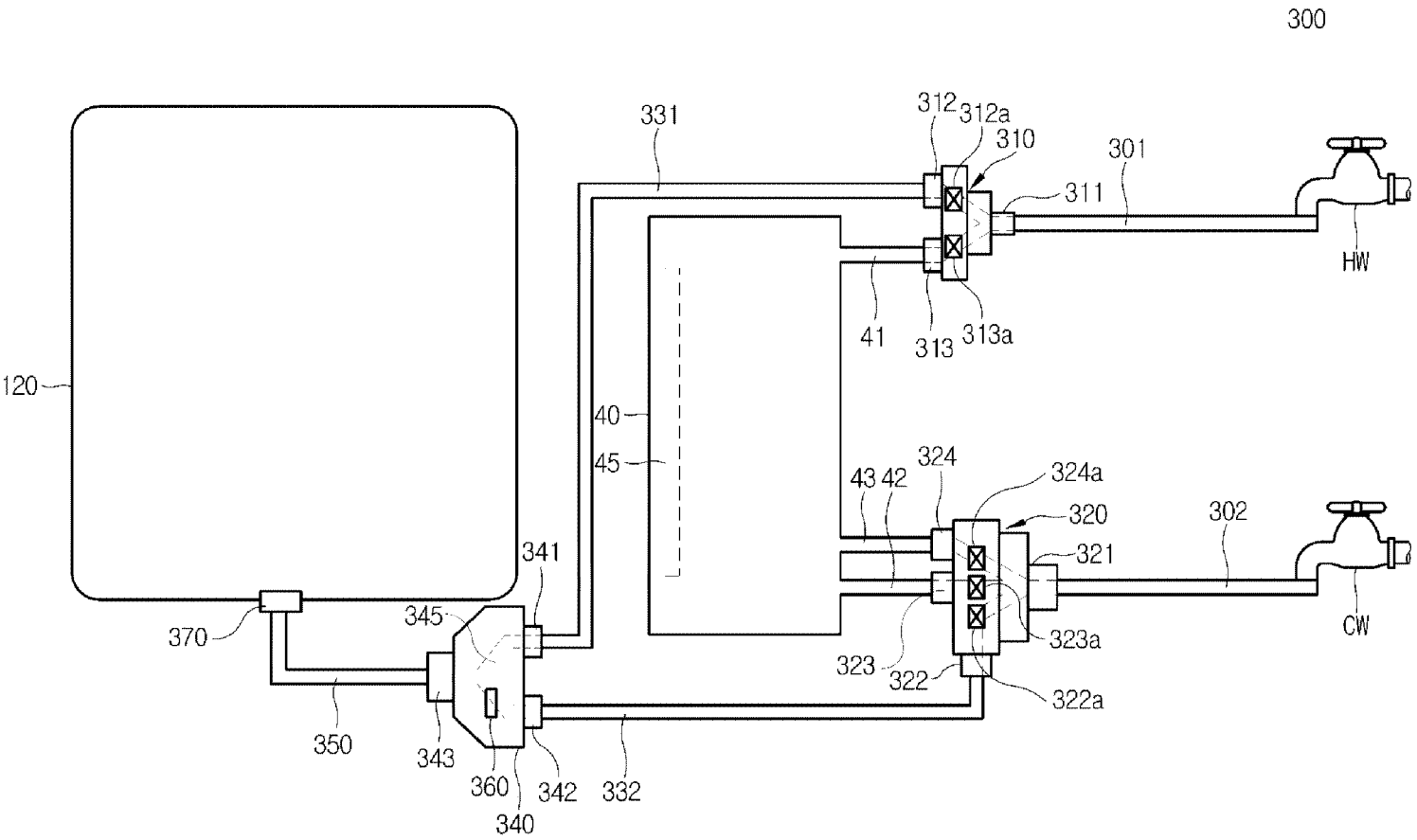
FIG. 14 is a mimetic diagram schematically illustrating a water supply apparatus of the washing machine in accordance with one embodiment of the present disclosure.
Figure 15:
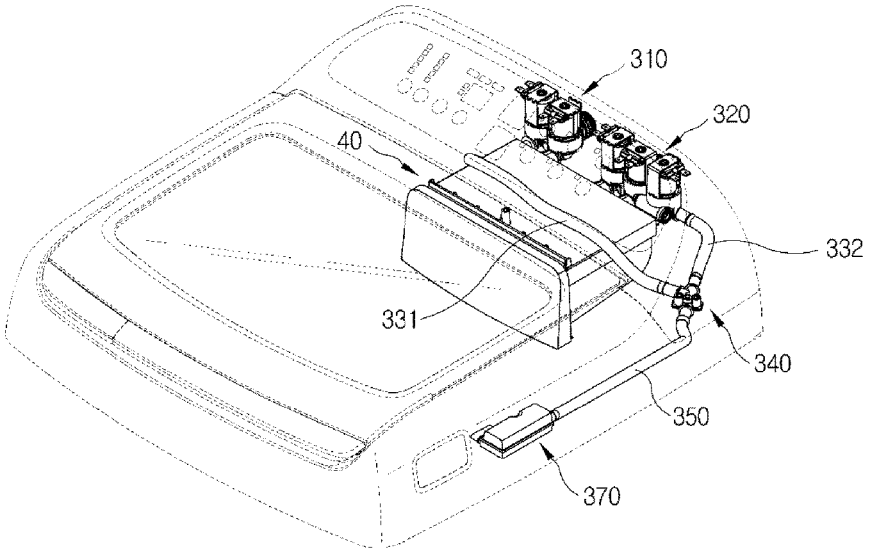
FIG. 15 is a perspective view illustrating an example of the water supply apparatus included in the washing machine in accordance with one embodiment of the present disclosure.
Figure 16:
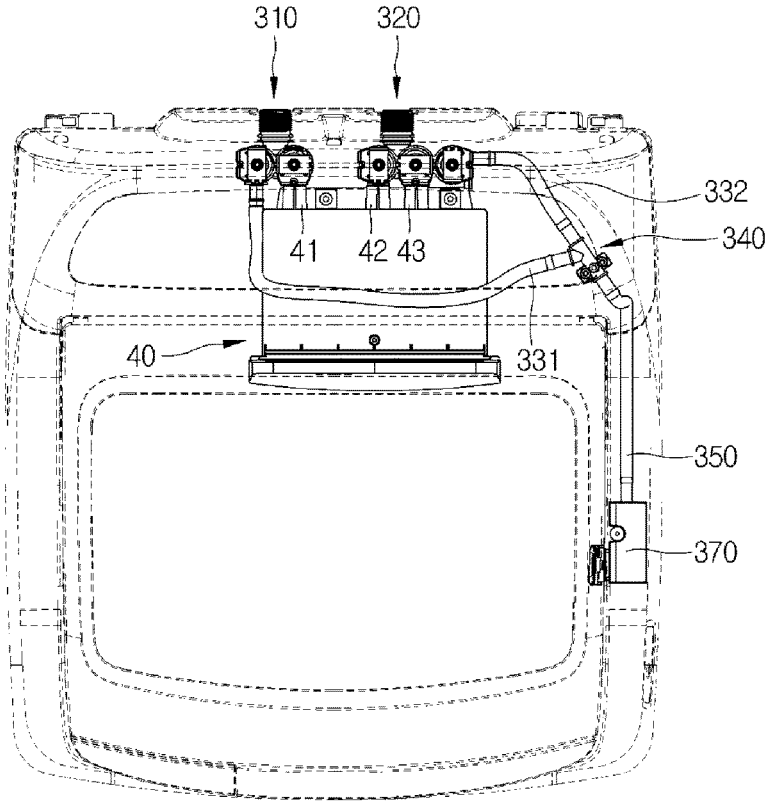
FIG. 16 is a top view illustrating an example of the water supply apparatus included in the washing machine in accordance with one embodiment of the present disclosure.

FIG. 14 is a mimetic diagram schematically illustrating a water supply apparatus of the washing machine in accordance with one embodiment of the present disclosure. FIG. 15 is a perspective view illustrating an example of the water supply apparatus included in the washing machine in accordance with one embodiment of the present disclosure. FIG. 16 is a top view illustrating an example of the water supply apparatus included in the washing machine in accordance with one embodiment of the present disclosure.

Figure 17:
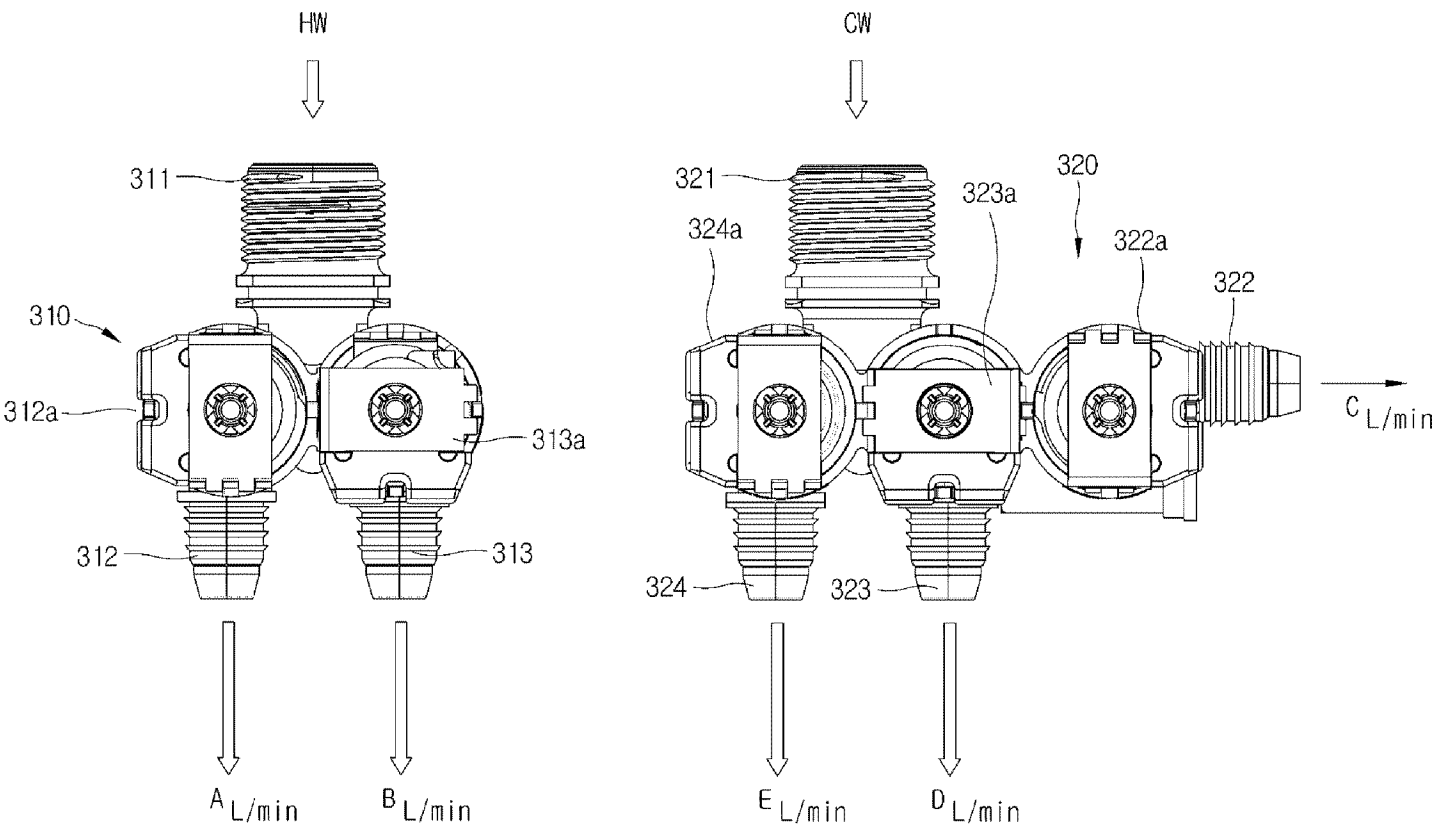
FIG. 17 is a view of a valve assembly of the water supply apparatus in accordance with one embodiment of the present disclosure.
Figure 18:
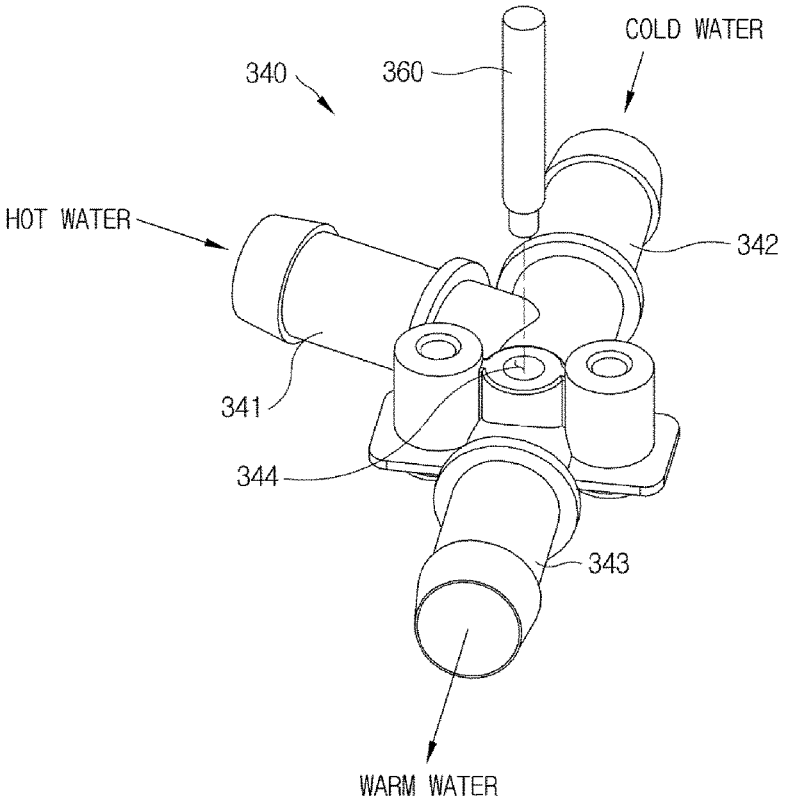
FIG. 18 is a view of a mixing device of the water supply apparatus in accordance with one embodiment of the present disclosure.
Figure 19:
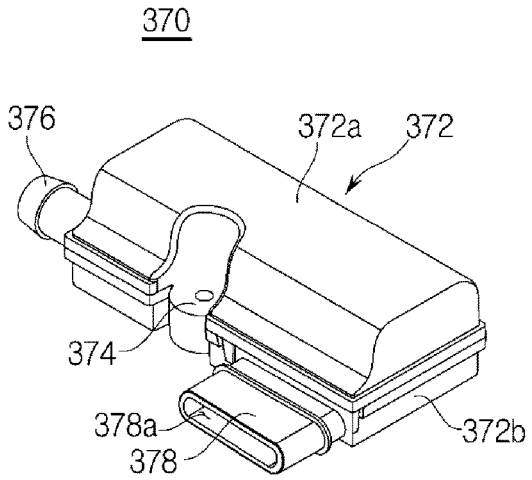
FIG. 19 is a perspective view of a water supply device of the water supply apparatus in accordance with one embodiment of the present disclosure.
Figure 20:
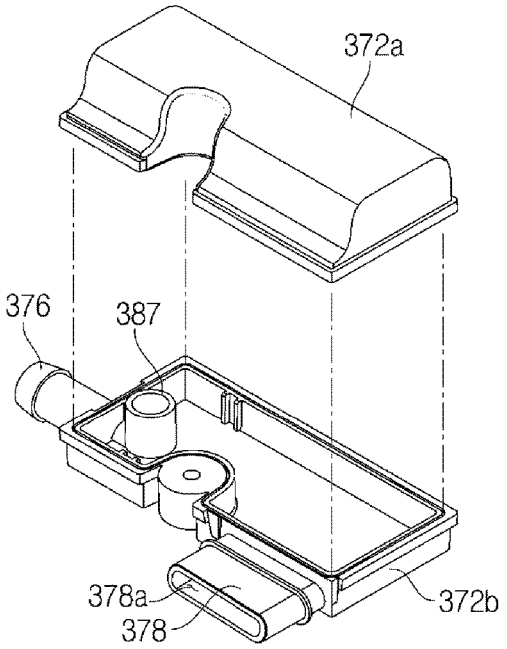
FIG. 20 is an exploded perspective view of the water supply device of the water supply apparatus in accordance with one embodiment of the present disclosure.

FIG. 17 is a view of a valve assembly of the water supply apparatus in accordance with one embodiment of the present disclosure. FIG. 18 is a view of a mixing device of the water supply apparatus in accordance with one embodiment of the present disclosure. FIG. 19 is a perspective view of a washing water supply device of the water supply apparatus in accordance with one embodiment of the present disclosure. FIG. 20 is an exploded perspective view of the washing water supply device of the water supply apparatus in accordance with one embodiment of the present disclosure.

Referring to FIGS. 14 to 16, the water supply apparatus 300 includes a hot water distributing device 310 which distributes hot water, a cold water distributing device 320 which distributes cold water, a mixing device 340 which mixes the hot water with the cold water, and a washing water supplier 370 which supplies water to the auxiliary washing unit 120.

The hot water distributing device 310 distributes hot water supplied from a hot water supply source HW. The hot water may be supplied to the main washing space 21*a* formed in the main washing unit 20 or the auxiliary washing space 120*a* formed in the auxiliary washing unit 120. Here, the supplying of hot water thereto by the hot water distributing device 310 may be independently performed.

For example, the hot water distributing device 310 may distribute the hot water only to the auxiliary washing unit 120 or only to the main washing unit 20. Also, the hot water distributing device 310 may distribute the hot water to both the auxiliary washing unit 120 and the main washing unit 20.

For the selective hot water distribution described above, the hot water distributing device 310 may be embodied as a 3-way valve.

In detail, the hot water distributing device 310 may include a hot water supply hole 311 through which hot water flows in, a first hot water discharge hole 312 which supplies hot water to the auxiliary washing unit 120, and a second hot water discharge hole 313 which supplies hot water to the main washing unit 20.

The hot water supply hole 311 is connected to the hot water supply source HW outside the washing machine 1 through a first water supply pipe 301. One end of the first water supply pipe 301 is connected to the hot water supply source HW, and the other end is connected to the hot water supply hole 311. Here, a gap between the first water supply pipe 301 and the hot water supply source HW and a gap between the first water supply pipe 301 and the hot water supply hole 311 may be sealed.

The hot water from the supply hole 311 may be discharged through the first hot water discharge hole 312 or the second hot water discharge hole 313.

The hot water discharged through the first hot water discharge hole 312 sequentially passes through a hot water pipe 331, the mixing device 340, a supply pipe 350, and the washing water supplier 370 and is supplied to the auxiliary washing space 120*a* of the auxiliary washing unit 120.

Also, the hot water from the second hot water discharge hole 313 passes through a detergent box 40 and is supplied to the main washing space 21*a* of the main washing unit 20. Here, the second hot water discharge hole 313 and the detergent box 40 may be connected through a first connection portion 41. The first connection portion 41 and the detergent box 40 may be integrally injection-molded. A gap between the first connection portion 41 and the second hot water discharge hole 313 may be sealed.

Hot water which flows into the detergent box 40 is mixed with a detergent in the detergent box 40 and falls into the main washing space 21*a* through an outlet 45 provided at a bottom end of the detergent box 40. Also, the hot water which flows into the detergent box 40 may be mixed with cold water supplied by the cold water distributing device 320 and supplied to the main washing space 21*a*.

The hot water distributing device 310 may include a plurality of hot water valves 312*a* and 313*a* to control distribution of hot water. The plurality of hot water valves 312*a* and 313*a* may be provided at flow channels connecting the hot water supply hole 311 and the hot water discharge holes 312 and 313 and may control the discharging of the hot water.

For example, a first hot water valve 312*a* may be provided between the hot water supply hole 311 and the first hot water discharge hole 312 and control distribution of hot water to the auxiliary washing space 120*a*, and a second hot water valve 313*a* may be provided between the hot water supply hole 311 and the second hot water discharge hole 313 and control distribution of hot water to the main washing space 21*a*.

Here, the hot water valves 312*a* and 313*a* may be embodied as solenoid valves capable of being electrically controlled to open and close and may be proportional control valves capable of controlling an opening degree of a flow channel.

The cold water distributing device 320 distributes cold water supplied from a cold water supply source CW. The cold water may be supplied to the main washing space 21*a* formed in the main washing unit 20 or the auxiliary washing space 120*a* formed in the auxiliary washing unit 120. Here, supplying of cold water thereto by the cold water distributing device 320 may be independently performed.

For example, the cold water distributing device 320 may distribute the cold water only to the auxiliary washing unit 120 or only to the main washing unit 20. For example, the cold water distributing device 320 may distribute the cold water to both the auxiliary washing unit 120 and the main washing unit 20.

For the selective cold water distribution, the cold water distributing device 320 may be embodied as a 4-way valve.

In detail, the cold water distributing device 320 may include a cold water supply hole 321 through which cold water flows in, a first cold water discharge hole 322 which supplies cold water to the auxiliary washing unit 120, and a second cold water discharge hole 323 and a third cold water discharge hole 324 which supply cold water to the main washing space 21*a*.

The cold water supply hole 321 is connected to the cold water supply source CW outside the washing machine 2 through a second water supply pipe 302. One end of the second water supply pipe 302 is connected to the cold water supply source CW, and the other end is connected to the cold water supply hole 321. Here, a gap between the second water supply pipe 302 and the cold water supply source CW and a gap between the second water supply pipe 302 and the cold water supply hole 321 may be sealed.

The cold water discharged through the first cold water discharge hole 322 sequentially passes through a cold water pipe 332, the mixing device 340, the supply pipe 350, the washing water supplier 370 and is supplied to the auxiliary washing space 120*a* of the auxiliary washing unit 120.

Also, the cold water discharged from the second cold water discharge hole 323 or the third cold water discharge hole 324 passes through the detergent box 40 and is supplied to the main washing space 21*a* of the main washing unit 20.

Here, the second cold water discharge hole 323 and the detergent box 40 may be connected through a second connection portion 42, and the third cold water discharge hole 324 and the detergent box 40 may be connected through a third connection portion 43. The second connection portion 42 and the third connection portion 43 may be integrally injection-molded together with the detergent box 40. A gap between the second connection portion 42 and the second cold water discharge hole 323 and a gap between the third connection portion 43 and the third cold water discharge hole 324 may be sealed.

Cold water which flows into the detergent box 40 is mixed with the detergent in the detergent box 40 and falls into the main washing space 21*a* through the outlet 45 provided at the bottom end of the detergent box 40. Also, cold water and hot water may be mixed with each other in the detergent box 40, thereby supplying warm water to the main washing space 21*a*.

The cold water distributing device 320 may include a plurality of cold water valves 322*a*, 323*a*, and 324*a* to control distribution of cold water. The plurality of cold water valves 322*a*, 323*a*, and 324*a* may be provided at flow channels connecting the cold water supply hole 321 to the cold water discharge holes 322, 323, and 324 and may control whether to discharge the cold water.

For example, a first cold water valve 322*a* is provided between the cold water supply hole 321 and the first cold water discharge hole 322 and controls distribution of cold water to the auxiliary washing space 120*a*. Also, the second cold water valve 323*a* is provided between the cold water supply hole 321 and the second cold water discharge hole 323, and the third cold water valve 324*a* is provided between the cold water supply hole 321 and the third cold water discharge hole 324 to control distribution of cold water to the main washing space 21*a*.

Here, the cold water valves 322*a*, 323*a*, and 324*a* may be embodied as solenoid valves capable of being electrically controlled to open and close and may be proportional control valves capable of controlling an opening degree of a flow channel.

Meanwhile, discharge flow rates of the cold water distributing device 320 and the hot water distributing device 310, as shown in FIG. 17, may be mutually different.

In detail, a flow rate A L/min of hot water discharged from the first hot water discharge hole 312 and a flow rate B L/min of hot water discharged from the second hot water discharge hole 313 may be mutually different.

Since the auxiliary washing space 120*a* has a smaller size than that of the main washing space 21*a*, the flow rate A L/min of hot water discharged from the first hot water discharge hole 312 may be smaller than the flow rate B L/min of hot water discharged from the second hot water discharge hole 313 (A<B).

For example, the flow rate A L/min of hot water discharged from the first hot water discharge hole 312 may be 2.5 L/min or 3.75 L/m, and the flow rate B L/min of hot water discharged from the second hot water discharge hole 313 may be 16 L/m.

To set a flow rate of hot water as described above, an area of the first hot water discharge hole 312 may be set to be smaller than an area of the second hot water discharge hole 313.

Meanwhile, when the hot water valves 312*a* and 313*a* are proportional control valves, the washing machine 1 may also control the flow rates of hot water discharged from the respective hot water discharge holes 312 and 313 by adjusting opening degrees of the hot water valves 312*a* and 313*a*.

Also, a flow rate C L/min cold of water discharged from the first cold water discharge hole 322, a flow rate D L/min of cold water discharged from the second cold water discharge hole 323, and a flow rate E L/min of cold water discharged from the third cold water discharge hole 324 may be mutually different.

Since the auxiliary washing space 120*a* has the smaller size than that of the main washing space 21*a*, the flow rate C L/min of cold water discharged from the first cold water discharge hole 322 may be smaller than the flow rate D L/min of cold water discharged from the second cold water discharge hole 323 or the flow rate E L/min of cold water discharged from the third cold water discharge hole 324 (C<D, C<E).

For example, the flow rate C L/min of cold water discharged from the first cold water discharge hole 322 may be 5 L/min or 3.75 L/min, the flow rate D L/min of cold water discharged from the second cold water discharge hole 323 may be 16 L/min, and the flow rate E L/min of cold water discharged from the third cold water discharge hole 324 may be 5 L/min.

The flow rates of cold water discharged from the second cold water discharge hole 323 and the third cold water discharge hole 324 may be set to be mutually different to control a water supply speed.

For example, the washing machine 1 may perform low speed water supply (E L/min) using the third cold water discharge hole 324 with the flow rate set to be relatively low or may perform high speed water supply (D L/min) using the second cold water discharge hole 323 with the flow rate set to be relatively high. Also, a rapid water supply (D+E L/min) may be performed using all of the second cold water discharge hole 323 and the third cold water discharge hole 324.

To set a flow rate of cold water as described above, an area of the first cold water discharge hole 322 may be set to be smaller than an area of the second cold water discharge hole 323 or an area of the third cold water discharge hole 324. Meanwhile, when the cold water valves 322*a*, 323*a*, and 324*a* are embodied as proportional control valves as described above, the washing machine 1 may control the flow rates of cold water discharged from the respective cold water discharge holes 322, 323, and 324 by adjusting opening degrees of the cold water valves 322*a*, 323*a*, and 324*a*.

Also, the flow rate A L/min of hot water discharged from the first hot water discharge hole 312 and the flow rate C L/min of cold water discharged from the first cold water discharge hole 322 may be mutually different.

Since auxiliary washing may be performed by the user in the auxiliary washing space 120*a*, it is necessary to supply water of an appropriate temperature to the auxiliary washing space 120*a*. That is, since the user may be scalded when a temperature of water to be supplied to the auxiliary washing space 120*a* is too high, the flow rates of the first hot water discharge hole 312 and the first cold water discharge hole 322 may be set to be mutually different to supply warm water to the auxiliary washing space 120*a*.

In detail, the flow rate of the first hot water discharge hole 312 may be set to be lower than the flow rate of the first cold water discharge hole 322. For example, when the flow rate of the first cold water discharge hole 322 is set to be 3.75 L/min, the flow rate of the first hot water discharge hole 312 may be set to be 2.5 L/min. When the flow rate of the first cold water discharge hole 322 is set to be 5 L/min, the flow rate of the first hot water discharge hole 312 may be set to be 3.75 L/min.

The mixing device 340 generates warm water by mixing cold water with cold water. The mixing device 340 may include a plurality of inlets 341 and 342 and a mixed water discharge hole 343.

A hot water inlet 341 is connected to the first hot water discharge hole 312 through the hot water pipe 331. Here, the hot water inlet 341 may be provided to correspond to an inner circumferential surface of the hot water pipe 331 and may be inserted into and connected to the hot water pipe 331.

One end of the hot water pipe 331 is connected to the first hot water discharge hole 312, and the other end thereof is connected to the hot water inlet 341 to guide hot water discharged from the first hot water discharge hole 312 to the mixing device 340.

A cold water inlet 342 is connected to the first cold water discharge hole 322 through the cold water pipe 332. Here, the cold water inlet 342 may be provided to correspond to an inner circumferential surface of the cold water pipe 332 and may be inserted into and connected to the cold water pipe 332.

One end of the cold water pipe 332 is connected to the first cold water discharge hole 322, and the other end thereof is connected to the cold water inlet 342 to guide cold water discharged from the first cold water discharge hole 322 to the mixing device 340.

The hot water which flows through the hot water inlet 341 and the cold water which flows through the cold water inlet 342 are mixed in a mixture chamber 345 inside the mixing device 340. That is, the hot water and the cold water are agitated together and become warm water in the mixture chamber 345.

The warm water generated in the mixture chamber 345 is discharged through the mixed water discharge hole 343. The warm water discharged through the mixed water discharge hole 343 passes through the supply pipe 350 and flows into the washing water supplier 370.

The mixing device 340 may further include a sensor mounting portion 344 on which a temperature sensor 360 is provided.

The sensor mounting portion 344 may be connected to the mixture chamber 345. The temperature sensor 360 may be mounted on the sensor mounting portion 344 and measure a temperature of mixed water in the mixture chamber 345.

The washing water supplier 370 supplies warm water which flows through the supply pipe 350 to the auxiliary washing unit 120.

As shown in FIGS. 19 and 20, the washing water supplier 370 may include a housing 372, a mixed water inlet 376, and mixed water outlet 378 provided at the housing 372.

The housing 372 has an approximate hexahedral shape in the embodiment, but the shape is not limited thereto. The housing 372 includes a top housing 372*a* and a bottom housing 372*b*. The top housing 372*a* and the bottom housing 372*b* are coupled with each other, thereby forming a space through which mixed water moves.

The housing 372 includes a coupling hole 374 formed to be coupled with an inside of the body 10 and may be coupled with the inside of the body 10 by screw-coupling.

The mixed water inlet 376 is connected to a water supply valve 361 and guides mixed water supplied from the water supply valve 361 to the inside of the housing 372.

The mixed water outlet 378 is provided to be connected to the inside of the housing 372 and to discharge mixed water to the auxiliary washing unit 120. An outflow channel 378*a* through which mixed water is discharged is formed inside the mixed water outlet 378.

Meanwhile, a structure for controlling a pressure of washing water which flows into the housing 372 by the mixed water inlet 376 may be provided inside the housing 372.

Hereinafter, a modified example of the water supply apparatus in accordance with one embodiment of the present disclosure will be described.

Figure 21:
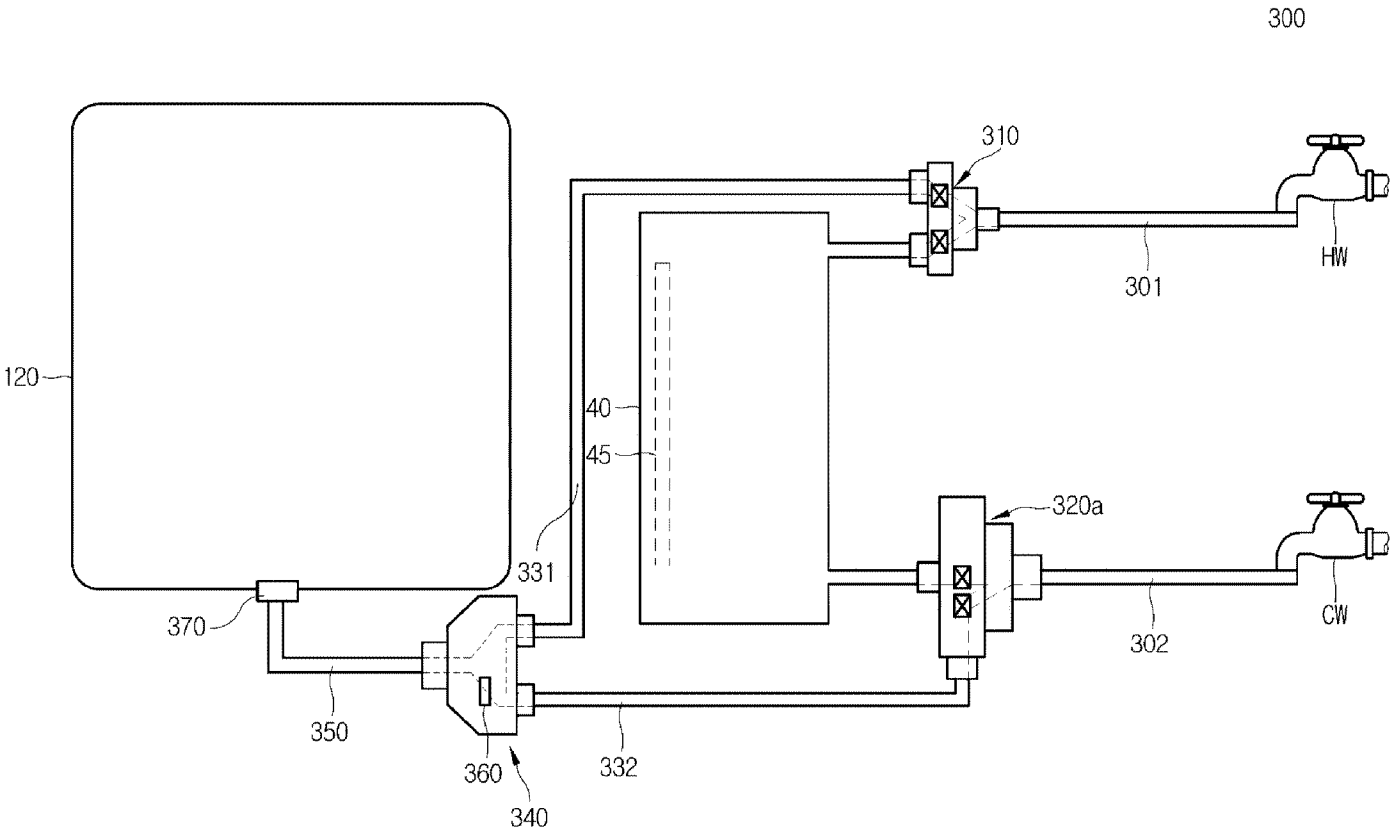
FIG. 21 is a view illustrating a modified example of a cold water distributing device of the water supply apparatus in accordance with one embodiment of the present disclosure.
Figure 22:
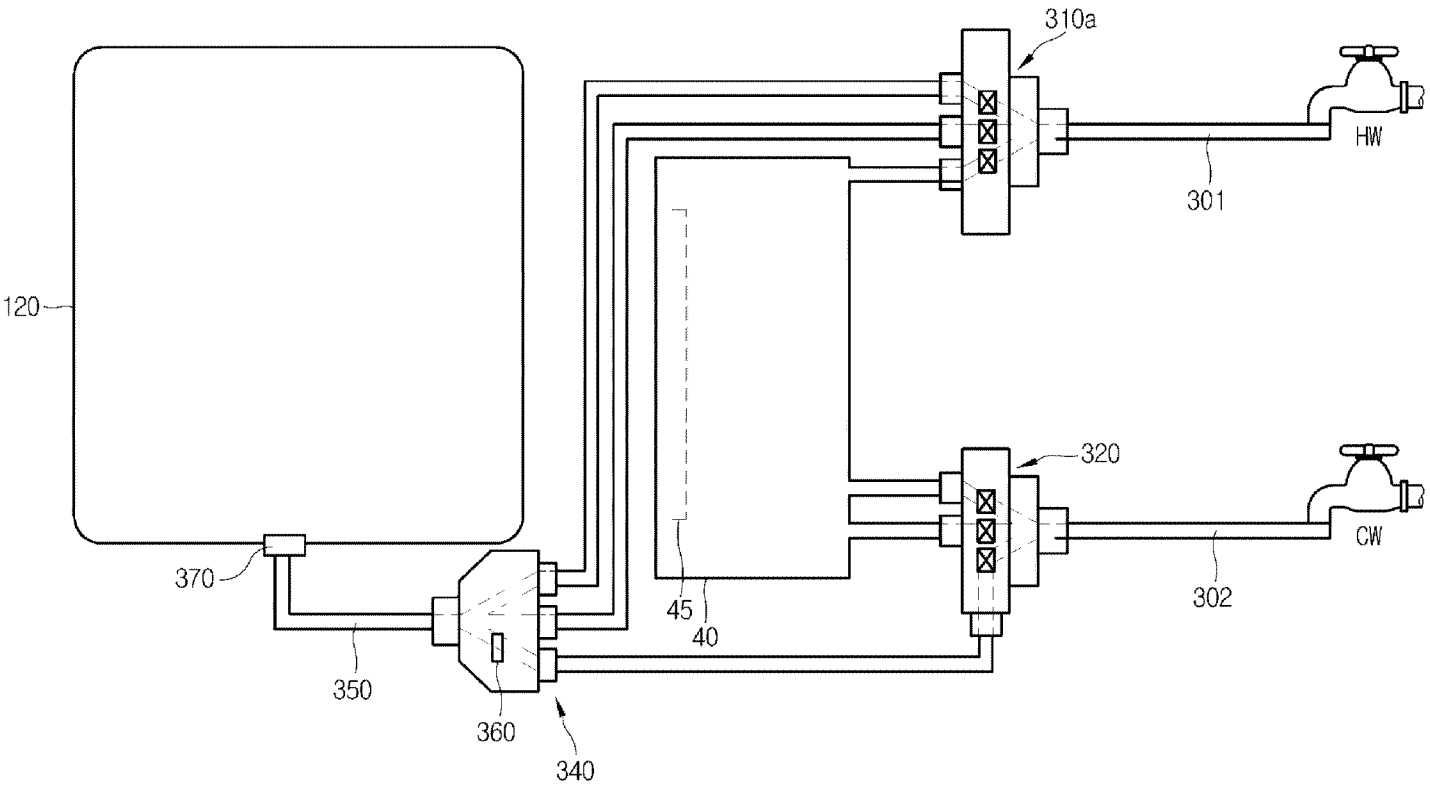
FIG. 22 is a view illustrating a modified example of a hot water distributing device of the water supply apparatus in accordance with one embodiment of the present disclosure.
Figure 23:
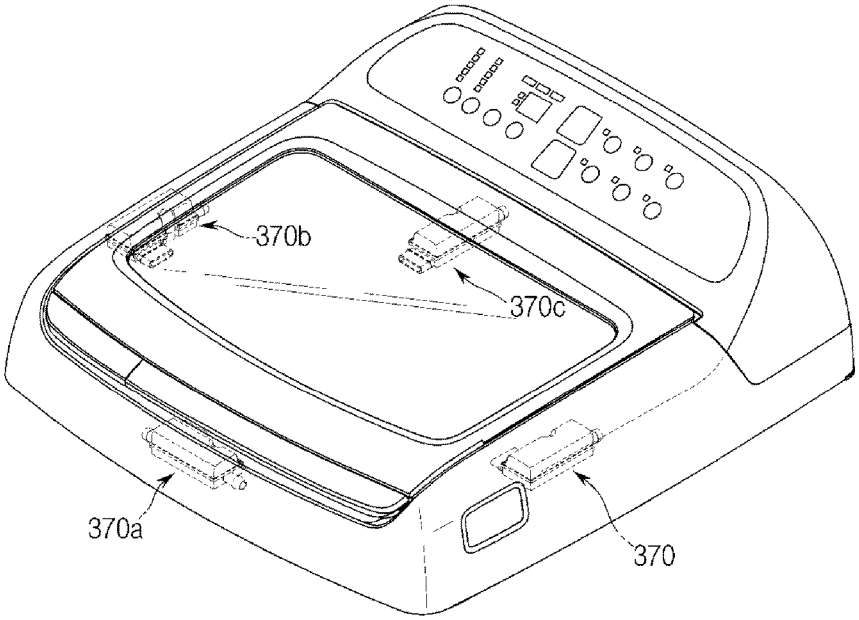
FIG. 23 is a view illustrating a modified example of a position of a water supply portion of the water supply apparatus in accordance with one embodiment of the present disclosure.

FIG. 21 is a view illustrating a modified example of the cold water distributing device of the water supply apparatus in accordance with one embodiment of the present disclosure. FIG. 22 is a view illustrating a modified example of the hot water distributing device of the water supply apparatus in accordance with one embodiment of the present disclosure. FIG. 23 is a view illustrating a modified example of a position of a water supply portion of the water supply apparatus in accordance with one embodiment of the present disclosure.

Although the hot water distributing device 310 is described as formed of the 3-way valve and the cold water distributing device 320 as formed of the 4-way valve in FIGS. 14 to 17, the hot water distributing device 310 and the cold water distributing device 320 are not limited thereto.

For example, as shown in FIG. 21, the cold water distributing device 320 may also be formed of a 3-way valve like the hot water distributing device 310.

Also, as shown in FIG. 22, the hot water distributing device 310 may also be formed of a 4-way valve to adjust an amount of hot water to be supplied to the auxiliary washing space 120*a*. Here, the flow rates of each of the discharge holes which discharge hot water to the auxiliary washing space 120*a* may be mutually different, and the washing machine 1 may control the amount of hot water to be supplied to the auxiliary washing space 120*a* by controlling opening and closing of the hot water discharge holes each having a different flow rate as described above.

Meanwhile, even though the washing water supplier 370 is located on the left side of the door assembly 100 in FIGS. 15 to 17, a position of the washing water supplier 370 is not limited thereto.

For example, the washing water supplier 370, as shown in FIG. 23, may be disposed on the right, in the front, and in the rear. Although it is shown that the washing water suppliers 370 are disposed in all the front, rear, and sides in FIG. 23 for convenience of description, the washing water supplier 370 may only be disposed at one of the locations.

As described above, as the position of the washing water supplier 370 is changed, the arrangement of the hot water pipe 331, the cold water pipe 332, the supply pipe 350, and the mixing device 340 may also be changed. Since the change in position as described above is obvious to one of ordinary skill in the art, a detailed description thereof will be omitted.

Hereinafter, the operation of the washing machine 1 will be described in detail.

Figure 24:
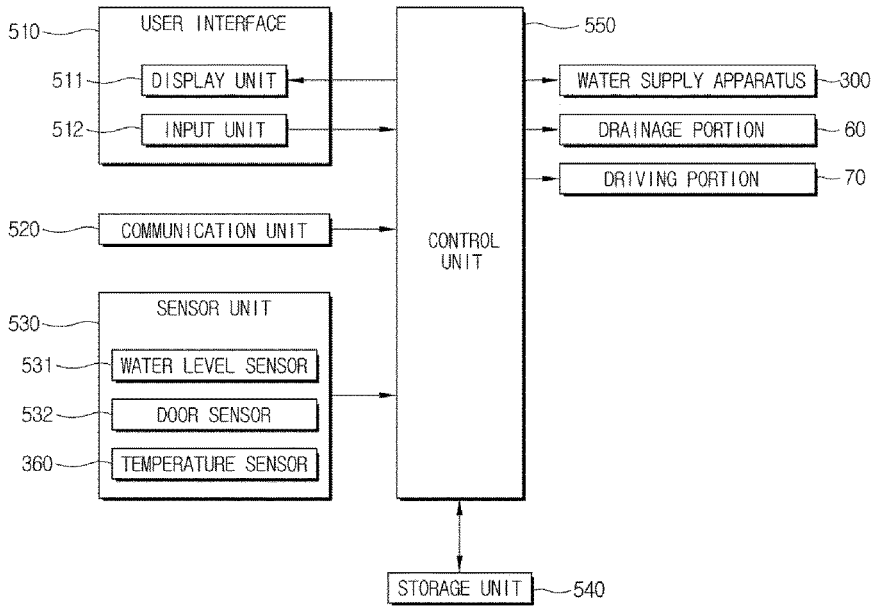
FIG. 24 is a control block diagram illustrating an operation of the washing machine in accordance with one embodiment of the present disclosure.

FIG. 24 is a control block diagram illustrating an operation of the washing machine in accordance with one embodiment of the present disclosure.

Referring to FIG. 24, the washing machine 1 in accordance with one embodiment of the present disclosure includes a user interface 510 for interaction with the user, a communication unit 520 for communication with external apparatuses, a sensor unit 530 for detecting a state of the washing machine 1, a storage unit 540 which stores information necessary for driving the washing machine 1, and a control unit 550 which controls the overall washing machine 1.

The user interface 510, as shown in FIG. 8A, may be provided behind the door assembly 100, but the position of the user interface 510 is not limited thereto.

Also, the user interface 510 may receive a control command of the user and display information for setting or driving the washing machine 1. For this, the user interface 510 may include a display unit 511 and an input unit 512.

The display unit 511 may display various types of information such as driving of the washing machine 1 and settings of the washing machine 1. For this, the display unit 511 may include at least one of display means including a seven-segment display, a plasma display panel (PDP), a liquid crystal display (LCD) panel, a light emitting diode (LED) panel, an organic LED (OLED) panel, an active-matrix OLED (AMOLED) panel, etc., but a method of embodying the display unit 511 is not limited thereto.

The input unit 512 receives a control command according to an input of the user and transmits an electric signal corresponding to the received control command to the control unit 550. To receive the control command, the input unit 512 may include at least one of input means including a push button, a membrane button, a slide switch, a rotating switch, a lever, a handle, a joystick, a dial, etc., but the method of embodying the input unit 512 is not limited thereto.

Also, the input unit 512 may further include a water supply button 513 (refer to FIG. 2) for supplying water to the auxiliary washing unit 120. The water supply button 513, as shown in FIG. 2, may be provided in front of the door assembly 100, but the position of the water supply button 513 is not limited thereto. For example, the water supply button 513, as shown in FIG. 11, may be provided at a side portion of the door assembly 100.

Also, the water supply button 513 may include a warm water button 513*a* for supplying warm water to the auxiliary washing unit 120 and a cold water button 513*b* for supplying cold water to the auxiliary washing unit 120.

Meanwhile, although it has been described that the water supply button 513 is separate from other parts of the user interface 510, the water supply button 513 may be provided in the user interface 510 provided behind the door assembly 100.

The communication unit 520 may be connected to communicate with external apparatuses. For example, the communication unit 520 may be connected to external apparatuses connected through a home network to receive a control command for the washing machine 1 or may transmit various types of information related to the washing machine 1 to external apparatuses.

The communication unit 520 may be connected to external apparatuses based on a wired/wireless communication method or a local area communication method. For example, the communication unit 520 may be connected to a nearby smart phone according to Wi-Fi or Bluetooth communication method or may be connected to a server located in a remote location through a wireless communication method.

The sensor unit 530 detects various types of information necessary for controlling the washing machine 1. In detail, the sensor unit 530 may include at least one of a water level sensor 531 for detecting a water level of the main washing unit 20, a door sensor 532 for detecting a state of the door assembly 100, and the temperature sensor 360 for detecting a temperature of washing water supplied to the auxiliary washing unit 120.

The water level sensor (refer to FIG. 1) is provided inside the fixed tub 21 and detects a water level of the fixed tub 21. That is, the water level sensor 531 may be vertically formed along the fixed tub 21. The water level sensor 531 may include a flow channel for allowing washing water to flow, and washing water in the fixed tub 21 may flow into the flow channel of the water level sensor 531 through a bottom end of the water level sensor 531. Here, since a height of the washing water in the water level sensor 531 and a height of the washing water in the fixed tub 21 are identical, the water level sensor 531 may detect the water level of the fixed tub 21 using the height of the washing water which flows into the flow channel.

Here, the method of measuring the water level by the water level sensor 531 is not limited. For example, the water level sensor 531 may measure the water level using one of a mechanical water level sensing method, a method using a semiconductor pressure sensor, and a capacitance measuring method.

The door sensor 532 detects the state of the door assembly 100. The door sensor 532 may include a Reed switch 532*a* (refer to FIG. 1) and a checker switch 532*b* (refer to FIG. 1).

The Reed switch 532*a* may sense a magnet provided at the handle portion 150 and may sense whether the door 110 is open or closed according to a strength of a magnetic field sensed by the Reed switch 532*a*. In detail, when the strength of the magnetic field sensed by the Reed switch 532*a* is a preset value or greater, the door 110 is sensed as being closed. When the strength of the magnetic field sensed by the Reed switch 532*a* is less than the preset value, the door 110 is sensed as being open.

The checker switch 532*b* may include a door opening and closing sensing lever which is in contact with the door 110 and senses an opening state of the door 110.

The temperature sensor 360 detects a temperature of warm water supplied to the auxiliary washing unit 120. The temperature sensor 360 may be embodied as a contact type temperature sensor 360 or a non-contact type temperature sensor 360.

In detail, the temperature sensor 360 may be embodied as at least one of a sensing resistor type temperature sensor 360 using resistance change of a metal due to a temperature change, a thermistor type temperature sensor 360 using resistance change of a semiconductor due to a temperature change, a thermocouple type temperature sensor 360 using an electromotive force generated at both ends of a contact point between two different types of metal lines of different materials, and an integrated circuit (IC) temperature sensor using voltages at both ends of a transistor or current-voltage properties of a P-N junction dependent on a temperature. However, the temperature sensor 360 is not limited thereto, and all available means for sensing a temperature may be used as the temperature sensor 360.

Also, the temperature sensor 360, as shown in FIG. 14, may be provided at the mixing device 340, but the position of the temperature sensor 360 is not limited thereto. For example, the temperature sensor 360 may be provided at the supply pipe 350 and the washing water supplier 370.

The storage unit 540 stores various types of data necessary for driving the washing machine 1. For example, the storage unit 540 may store an operating system or a firm ware necessary for driving the washing machine 1 or may store various types of data generated due to driving the washing machine 1.

Also, the storage unit 540, for example, may include a high-speed random access memory (RAM), a magnetic disc, a static RAM (SRAM), a dynamic RAM (DRAM), a read-only memory (ROM), etc. but is not limited thereto.

Also, the storage unit 540 may be detachable from the door assembly 100. For example, the storage unit 540 may include a compact flash (CF) card, a secure digital (SD) card, a smart media (SM) card, a multimedia card (MMC), or a memory stick but is not limited thereto.

The control unit 550 controls the overall driving of the washing machine 1. The control unit 550 may correspond to one or more processors.

A processor may be embodied as a plurality of logic gate arrays or may be embodied as a combination of a general microprocessor and a memory in which a program executable in the microprocessor is stored.

Figure 25:
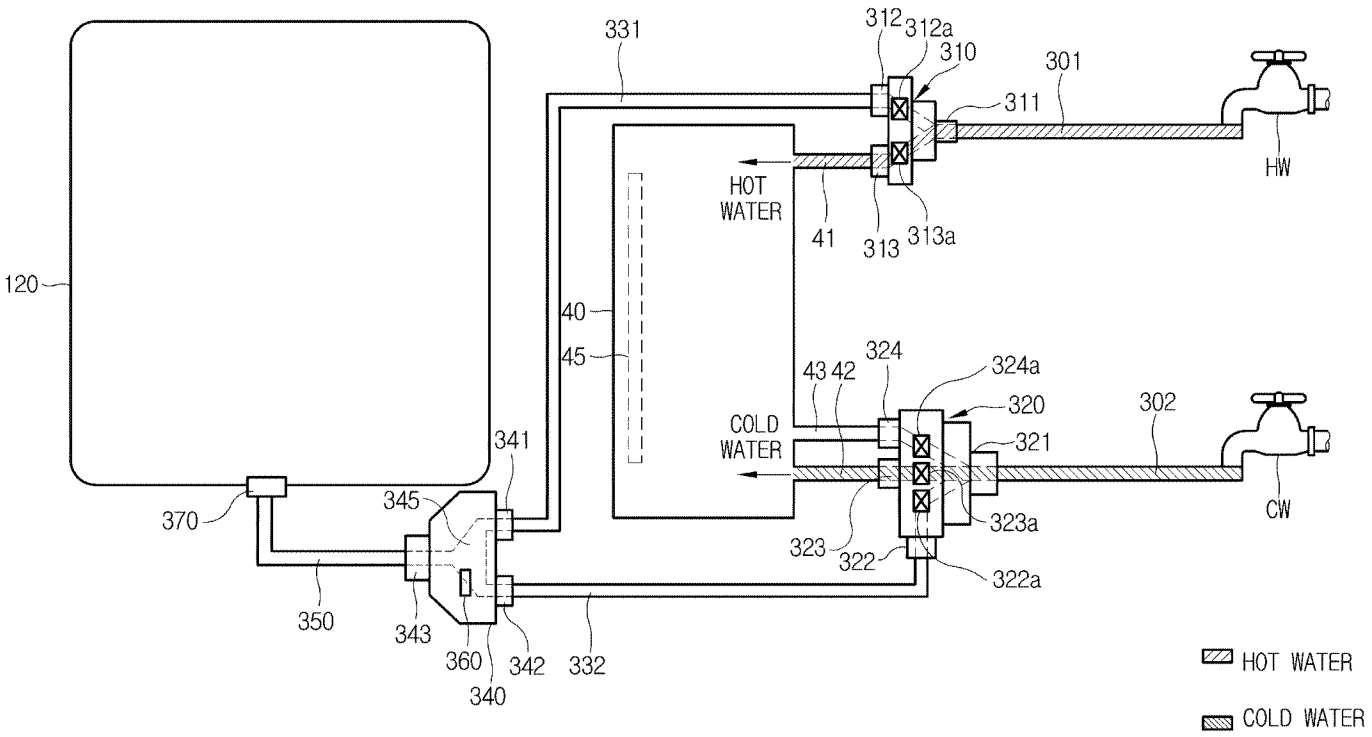
FIG. 25 is a view illustrating warm water supply to a main washing unit.

Meanwhile, the storage unit 540 and the control unit 550 are separately provided from each other in FIG. 25 but may also be embodied as one chip.

In detail, the control unit 550 may control each of the components of the washing machine 1 based on a control command input through the user interface 510 and may display information related to driving or setting of the washing machine 1 by controlling the user interface 510.

Also, the control unit 550 may discharge washing water in the washing machine 1 to the outside by controlling the drainage portion 60. In detail, the control unit 550 may adjust discharging of the washing water by controlling opening and closing of the drainage valve 63.

Also, the control unit 550 may perform main washing by controlling the driving portion 70. In detail, the control unit 550 may perform the main washing by controlling the motor 71 and the power switching apparatus 75 to rotate the rotating tub 22 and the pulsator 29.

Also, the control unit 550 may control supplying of washing water by controlling the water supply apparatus 300. In detail, the control unit 550 may control cold water supply to the main washing space 21*a* or the auxiliary washing space 120*a* by controlling the cold water distributing device 320 and may control hot water supply to the main washing space 21*a* or the auxiliary washing space 120*a* by controlling the hot water distributing device 310.

Also, the control unit 550 may control the cold water distributing device 320 and the hot water distributing device 310 to supply warm water to the main washing space 21*a* or the auxiliary washing space 120*a*.

Water supply to the main washing space 21*a* and the auxiliary washing space 120*a* may be independently achieved. In detail, the control unit 550 may control the water supply apparatus 300 to supply water to only one of the main washing space 21*a* and the auxiliary washing space 120*a* and if necessary may also control the water supply apparatus 300 to supply water to both the main washing space 21*a* and the auxiliary washing space 120*a* at the same time.

When the water is supplied to both the main washing space 21*a* and the auxiliary washing space 120*a* at the same time, temperatures of water supplied to each of the spaces may be mutually different. For example, cold water may be supplied to the main washing space 21*a*, and warm water may be supplied to the auxiliary washing space 120*a*.

Hereinafter, controlling of warm water supply will be described in detail.

Figure 26:
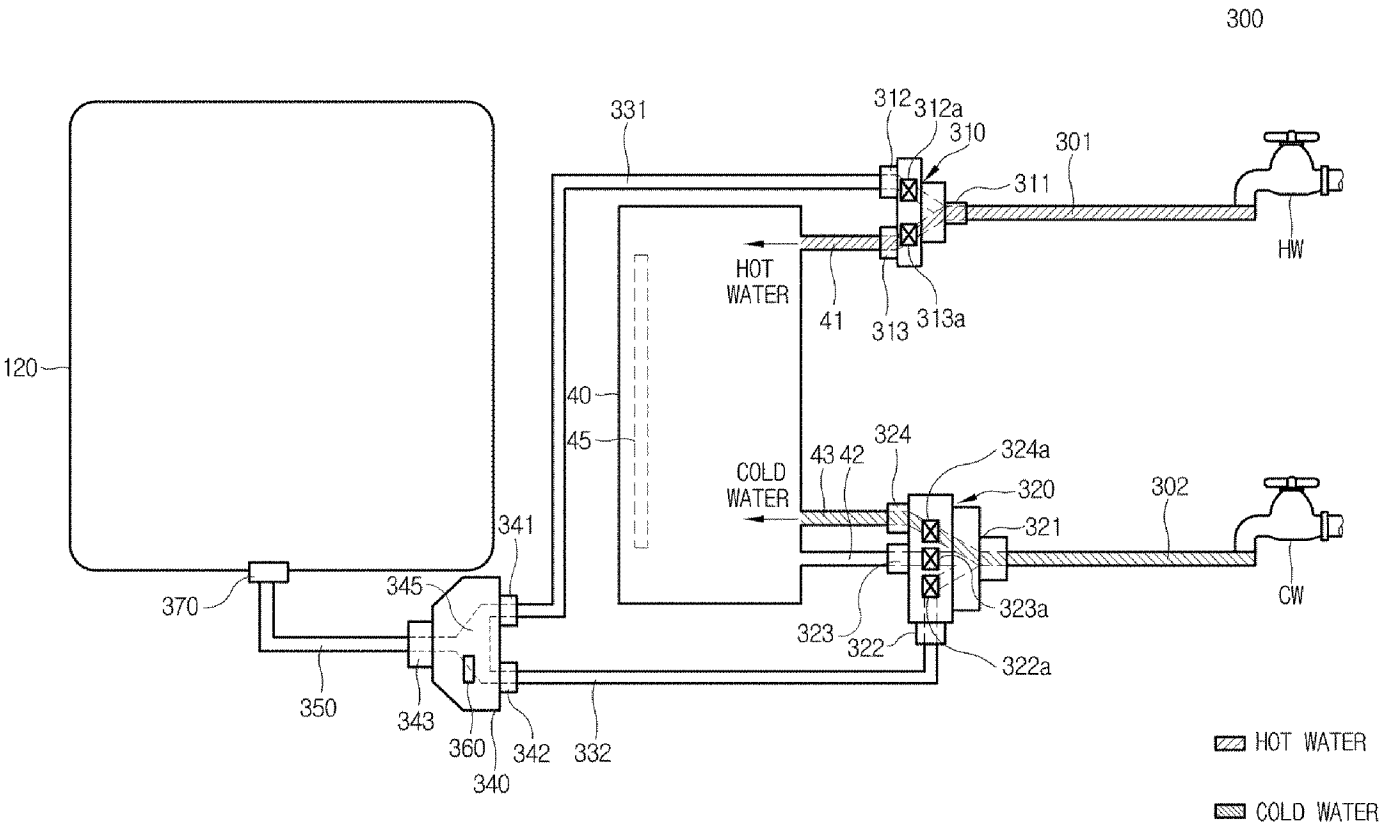
FIG. 26 is a view illustrating the warm water supply to the main washing unit.
Figure 27:
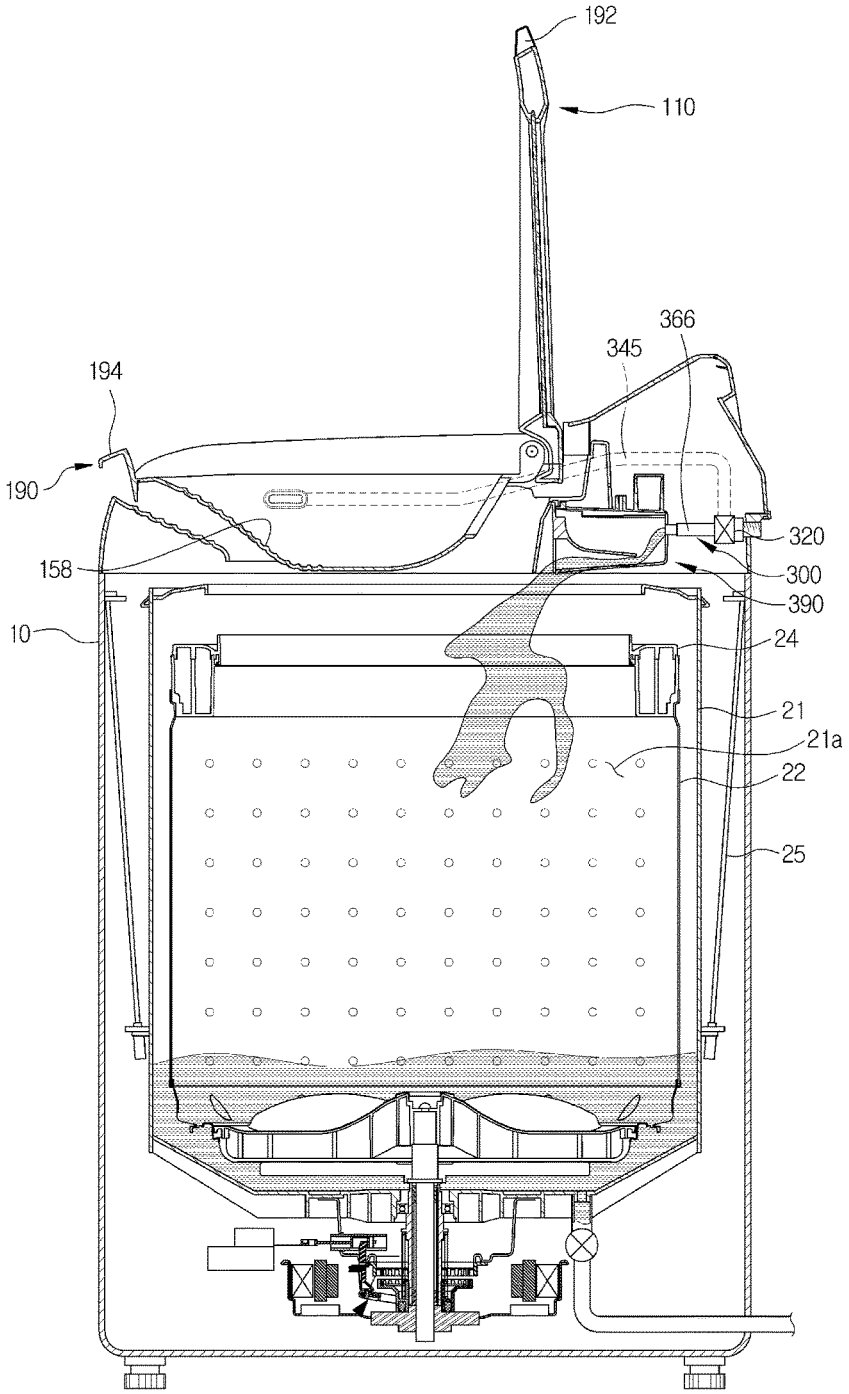
FIG. 27 is a diagram schematically illustrating the warm water supply to the main washing unit.

FIGS. 25 and 26 are views illustrating warm water supply to the main washing unit, and FIG. 27 is a diagram schematically illustrating the warm water supply to the main washing unit.

Referring to FIG. 27, the washing machine 1 may supply warm water to the main washing unit 20. In detail, the control unit 550 opens the second hot water valve 313*a* of the water supply apparatus 300 to supply hot water to the detergent box 40. When the second hot water valve 313*a* is opened, hot water which flows in through the first water supply pipe 301 sequentially passes through the second hot water discharge hole 313 and the second connection portion 42 and is supplied to the detergent box 40. Here, flow rate of the hot water to be supplied to the detergent box 40 may be adjusted by the area of the second hot water discharge hole 313 or an opening degree of the second hot water valve 313*a*.

Also, the control unit 550 may open at least one of the second cold water valve 323*a* and the third cold water valve 324*a* of the water supply apparatus 300 to supply cold water to the detergent box 40. The cold water which flows in through the second water supply pipe 302 sequentially passes through a discharge hole with an open valve and a connection portion and is supplied to the detergent box 40.

Here, the control unit 550 may adjust the amount of cold water to be supplied to the main washing unit 20 by controlling opening degrees of the cold water valves 322*a*, 323*a*, and 324*a*. In detail, as shown in FIG. 25, when the second cold water valve 323*a* is opened, the cold water is supplied through the second cold water discharge hole 323 with a relatively high flow rate. As shown in FIG. 26, when the third cold water valve 324*a* is opened, the cold water is supplied through the third cold water discharge hole 324 with a relatively low flow rate.

Accordingly, the control unit 550 may perform a low speed water supply by opening the second cold water valve 323*a*, may perform a high speed water supply by opening the third cold water valve 324*a*, and may perform a water supply by opening both of the second cold water valve 323*a* and the third cold water valve 324*a*.

Figure 28:
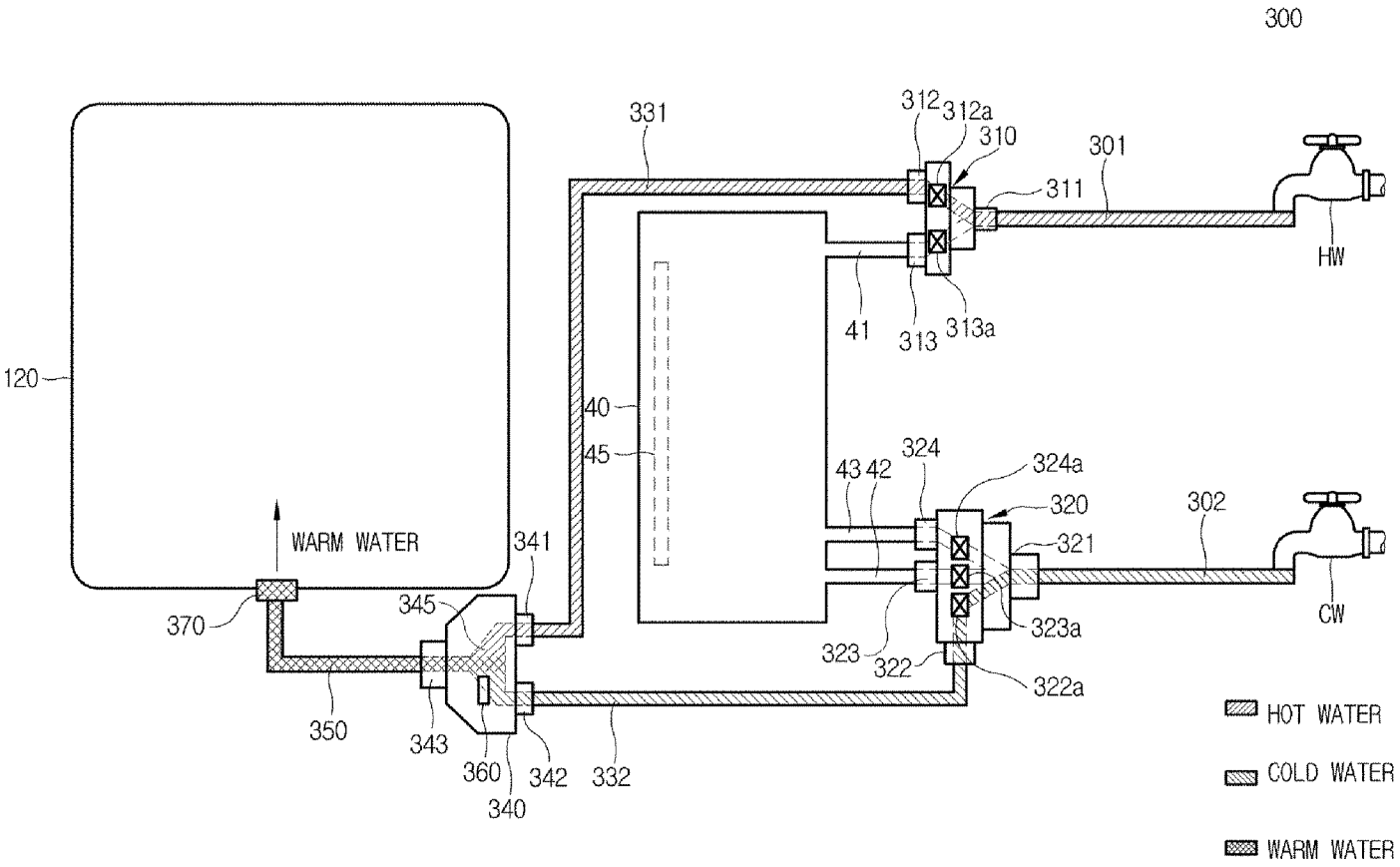
FIG. 28 is a view illustrating the warm water supply to the main washing unit.

As described above, the hot water and cold water supplied to the detergent box 40 are mixed in the detergent box 40 and, as shown in FIG. 28, flow down to the main washing space 21*a* through the outlet 45 provided at the bottom end of the detergent box 40.

Figure 29:
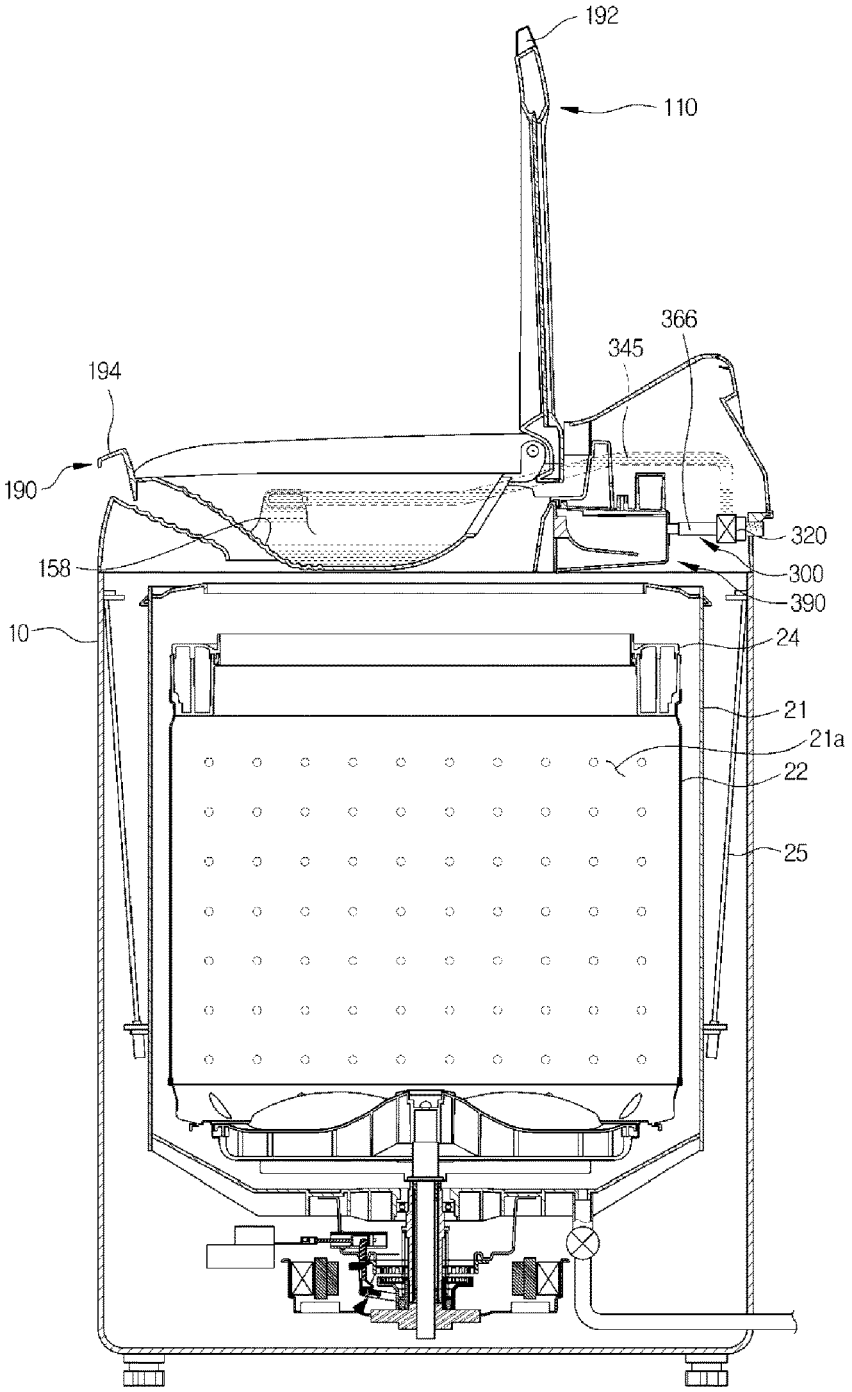
FIG. 29 is a diagram schematically illustrating the warm water supply to the main washing unit.
Figure 30:
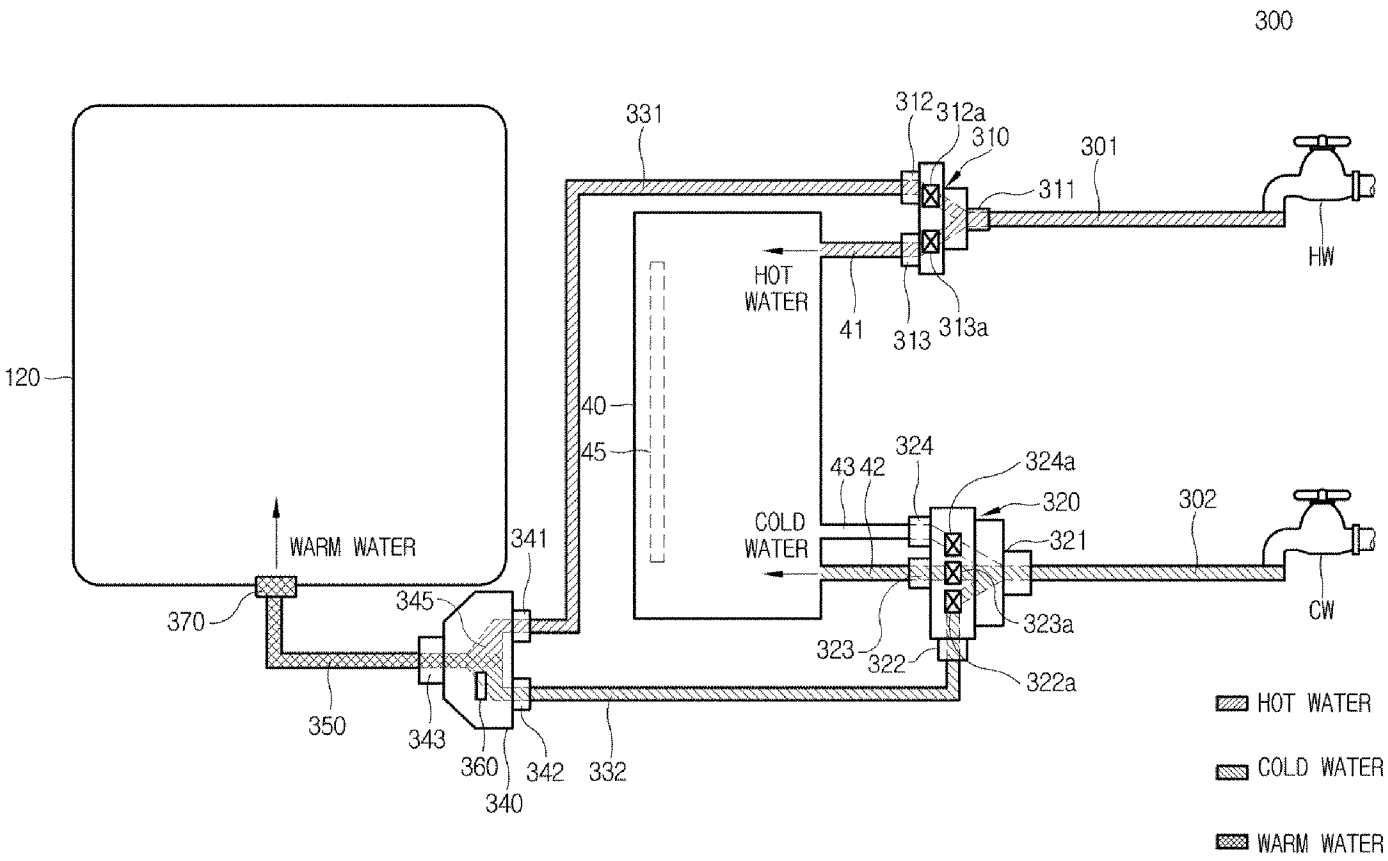
FIG. 30 is a view illustrating warm water supply to the main washing unit and the auxiliary washing unit.

FIG. 28 is a view illustrating a warm water supply to the main washing unit. FIG. 29 is a diagram schematically illustrating the warm water supply to the main washing unit. FIG. 30 is a view illustrating warm water supply to the main washing unit and the auxiliary washing unit.

Referring to FIG. 29, the washing machine 1 may supply warm water to the auxiliary washing unit 120. In detail, the control unit 550 opens the first hot water valve 312*a* and the first cold water valve 322*a* to supply hot water to the mixing device 340.

When the first hot water valve 312*a* is opened, hot water which flows through the second water supply pipe 302 sequentially passes through the first hot water discharge hole 312 and the hot water pipe 331 and is supplied to the mixing device 340. Also, when the first cold water valve 322*a* is opened, cold water which flows through the second water supply pipe 302 sequentially passes through the first cold water discharge hole 322 and the cold water pipe 332 and is supplied to the mixing device 340.

The cold water and hot water which flow into the mixing device 340 are mixed in the mixture chamber 345 inside the mixing device 340. Warm water generated by mixing the cold water with the hot water, as shown in FIG. 29, may pass through the supply pipe 350 and the washing water supplier 370 and may be discharged to the auxiliary washing unit 120.

The control unit 550 may control the temperature of warm water supplied to the auxiliary washing space 120*a* by controlling the hot water distributing device 310 and the cold water distributing device 320. Here, the temperature of the warm water supplied to the auxiliary washing space 120*a* may be measured by the temperature sensor 360.

As an example, the control unit 550 may adjust the temperature of the warm water supplied to the auxiliary washing unit 120 by controlling opening and closing of the first hot water valve 312*a*. That is, when the temperature of the warm water supplied to the auxiliary washing space 120*a* is a preset first critical temperature or higher, the first hot water valve 312*a* may be shut off to prevent the user from being scalded.

Here, the first critical temperature indicates a maximum temperature of warm water to be supplied to the auxiliary washing space 120*a* and may be preset. For example, the first critical temperature may be set as 40° C.

Also, when the temperature of the warm water supplied to the auxiliary washing space 120*a* is a preset second critical temperature or lower, the first hot water valve 312*a* may be opened. Here, the second critical temperature indicates a minimum temperature of warm water to be supplied to the auxiliary washing space 120*a* and may be preset. For example, the second critical temperature may be set as 20° C.

That is, the control unit 550 may control the temperature of the warm water supplied to the auxiliary washing unit 120 by controlling an opening time of the first hot water valve 312*a*.

As another example, the control unit 550 may control the temperature of the warm water by controlling an opening degree of the first hot water valve 312*a* or the first cold water valve 322*a*. In detail, when the temperature of the warm water supplied to the auxiliary washing space 120*a* is the preset first critical temperature or higher, the control unit 550 may lower the temperature of the warm water to be supplied to the auxiliary washing space 120*a* by decreasing the opening degree of the first hot water valve 312*a* or increasing the opening degree of the first cold water valve 322*a*.

On the contrary, when the temperature of the warm water supplied to the auxiliary washing space 120*a* is the preset second critical temperature or lower, the control unit 550 may raise the temperature of the warm water to be supplied to the auxiliary washing space 120*a* by increasing the opening degree of the first hot water valve 312*a* or decreasing the opening degree of the first cold water valve 322*a*.

As still another example, when there are a plurality of hot water valves for supplying hot water to the auxiliary washing space 120*a* as shown in FIG. 23, the control unit 550 may control the temperature of the warm water supplied to the auxiliary washing space 120*a* by adjusting an amount of hot water to be supplied to the mixing device 340 by controlling opening and closing of the plurality of hot water valves.

In detail, when the temperature of the warm water supplied to the auxiliary washing space 120*a* is the preset first critical temperature or higher, the control unit 550 may reduce a flow rate of hot water to be supplied to the mixing device 340 by closing at least one of the plurality of hot water valves 312*a* and 313*a*.

On the contrary, when the temperature of the warm supplied to the auxiliary washing space 120*a* is the preset second critical temperature or less, the control unit 550 may increase the flow rate of the hot water to be supplied to the mixing device 340 by opening at least one of the plurality of hot water valves 312*a* and 313*a*.

Meanwhile, the control unit 550, as shown in FIG. 30, may supply warm water to the main washing unit 20 and the auxiliary washing unit 120 at the same time.

A temperature of washing water supplied to the main washing unit 20 and a temperature of washing water supplied to the auxiliary washing unit 120 may be mutually different. That is, since the warm water supplied to the main washing unit 20 is not in direct contact with the user, the temperature of the warm water supplied to the main washing unit 20 may be higher than the temperature of the warm water supplied to the auxiliary washing unit 120.

That is, the control unit 550 may adjust the temperature of the warm water to be supplied to the main washing unit 20 and the temperature of the warm water to be supplied to the auxiliary washing unit 120 by controlling distribution of hot water or distribution of cold water.

Particularly, the control unit 550 may control the hot water distributing device 310 or the cold water distributing device 320 to supply warm water within a preset critical temperature range to the auxiliary washing unit 120.

Hereinafter, a method of supplying warm water to the auxiliary washing unit 120 will be described in detail with reference to FIGS. 31 to 35.

Figure 31:
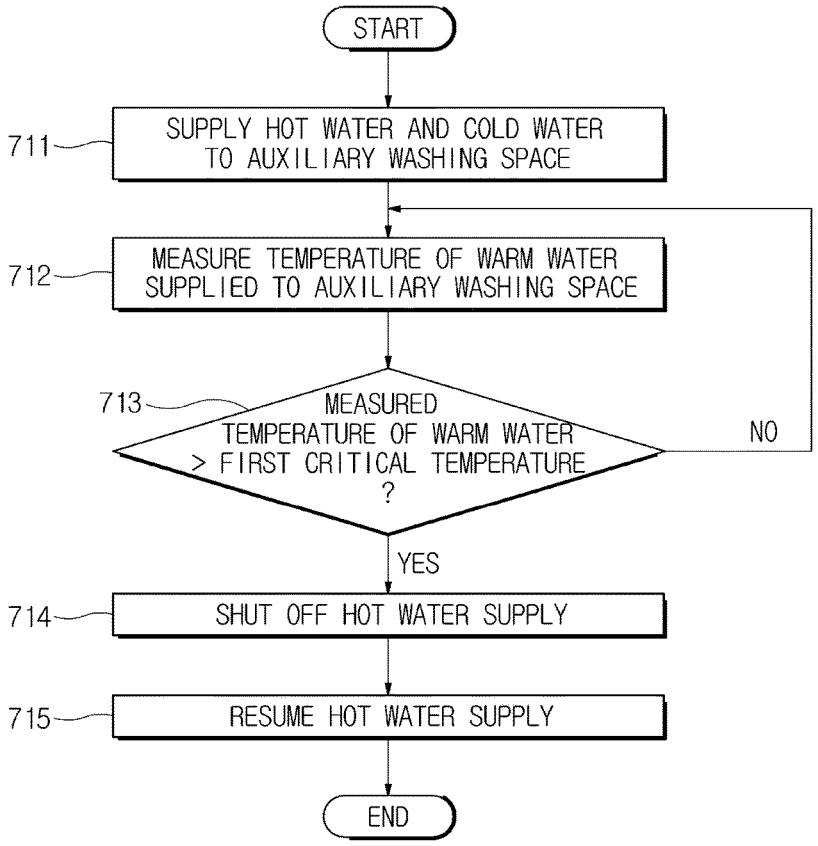
FIG. 31 is a flowchart illustrating an example of controlling the warm water supply of the washing machine in accordance with one embodiment of the present disclosure.

FIG. 31 is a flowchart illustrating an example of controlling warm water supply of the washing machine in accordance with one embodiment of the present disclosure.

Referring to FIG. 31, the washing machine 1 supplies hot water and cold water to the auxiliary washing space 120*a* (S711). In detail, the control unit 550 supplies the hot water and cold water to the mixing device 340 by controlling the hot water distributing device 310 and the cold water distributing device 320. The cold water and hot water supplied to the mixing device 340 are mixed in the mixture chamber 345 inside the mixing device 340 and then pass through the supply pipe 350 and the washing water supplier 370 and are discharged to the auxiliary washing space 120*a*. As a result, warm water generated by mixing the hot water with the cold water is supplied to the auxiliary washing space 120*a*.

The washing machine 1 measures a temperature of the warm water to be supplied to the auxiliary washing space 120*a* (S712). In detail, the temperature of the warm water may be measured by the temperature sensor 360 provided inside the mixture chamber 345, but the position of the temperature sensor 360 is not limited thereto.

The washing machine 1 determines whether the measured temperature of the warm water is higher than a first critical temperature (S713). Here, the first critical temperature is preset to prevent the user from being scalded.

When the measured temperature of the warm water is higher than the first critical temperature (YES in S713), the washing machine 1 shuts off hot water supply (S714). In detail, the control unit 550 shuts off the hot water to be supplied to the auxiliary washing space 120*a* by closing the first hot water valve 312*a* of the hot water distributing device 310. When the hot water supply of the hot water distributing device 310 is shut off, since only cold water is supplied to the mixing device 340, the temperature of the warm water to be supplied to the auxiliary washing space 120*a* decreases.

Then, the washing machine 1 resumes the hot water supply (S715). The resuming of the hot water supply may be performed after a preset time passes, but is not limited thereto.

The washing machine 1 may repeatedly perform operations S712 to S715 described above when the warm water is being supplied to the auxiliary washing unit 120. That is, the control unit 550 may adjust the temperature of the warm water to be supplied to the auxiliary washing unit 120 by controlling opening and closing of the first hot water valve 312*a*.

Figure 32:
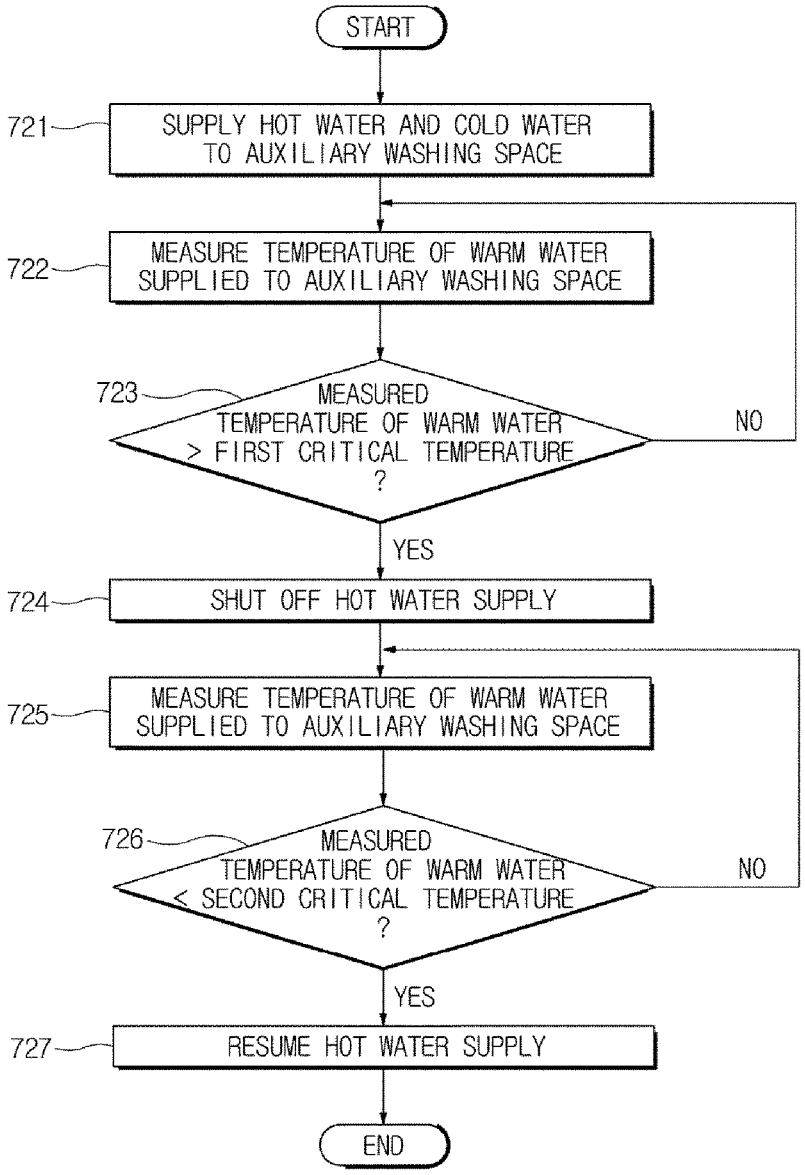
FIG. 32 is a flowchart illustrating another example of controlling warm water supply of the washing machine in accordance with one embodiment of the present disclosure.
Figure 33:
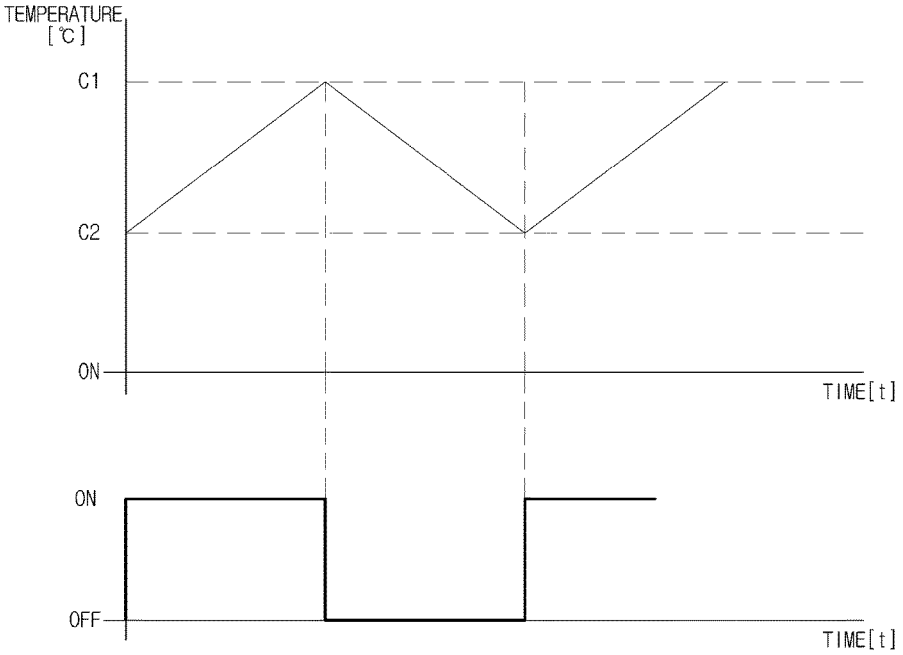
FIG. 33 is a view illustrating opening and closing of a hot water valve depending on a critical temperature.

FIG. 32 is a flowchart illustrating another example of controlling of the warm water supply of the washing machine in accordance with one embodiment of the present disclosure. FIG. 33 is a view illustrating opening and closing of the hot water valve depending on the critical temperature. A top graph in FIG. 33 illustrates a temperature change of warm water measured by the temperature sensor, and a bottom graph illustrates an operation of the hot water valve according to the temperature change of the warm water.

Referring to FIG. 32, the washing machine 1 supplies hot water and cold water to the auxiliary washing space 120*a* (S721).

The washing machine 1 measures a temperature of warm water to be supplied to the auxiliary washing space 120*a* (S722).

The washing machine 1 determines whether the measured temperature of the warm water is higher than a first critical temperature (S723). When the measured temperature of the warm water is the first critical temperature or lower (NO in S723), the washing machine 1 may continue to supply the hot water and cold water (S721).

On the other hand, when the measured temperature of the warm water is higher than the first critical temperature (YES in S723), the washing machine 1 shuts off hot water supply (S724). For example, when the temperature of the warm water becomes a first critical temperature C1 as shown in FIG. 33, the washing machine 1 may close off the first hot water valve 312*a* to switch off the hot water to be supplied to the auxiliary washing space 120*a*. As a result, only the cold water is supplied to the mixing device 340.

The washing machine 1 measures the temperature of the warm water to be supplied to the auxiliary washing space 120*a* (S725) and determines whether the temperature of the warm water is a second critical temperature or lower (S726). When the first hot water valve 312*a* is closed off, since only the cold water is supplied to the mixing device 340, the temperature of the warm water to be supplied to the auxiliary washing space 120*a* gradually decreases as shown in FIG. 33. When the measure temperature is a second critical temperature C2 or higher (NO in S726), only the cold water is supplied to the mixing device 340.

When the measured temperature of the warm water is lower than the second critical temperature (YES in S726), the washing machine 1 resumes hot water supply (S727). Here, the second critical temperature may be preset. That is, when a temperature detected by the temperature sensor 360 becomes C2, the control unit 550 may supply hot water to the mixing device 340 by opening the first hot water valve 312*a* again.

As a result, the washing machine 1, as shown in FIG. 33, may supply warm water within a range from the first critical temperature to the second critical temperature to the auxiliary washing space 120*a* by controlling opening and closing of the first hot water valve 312*a*.

Figure 34:
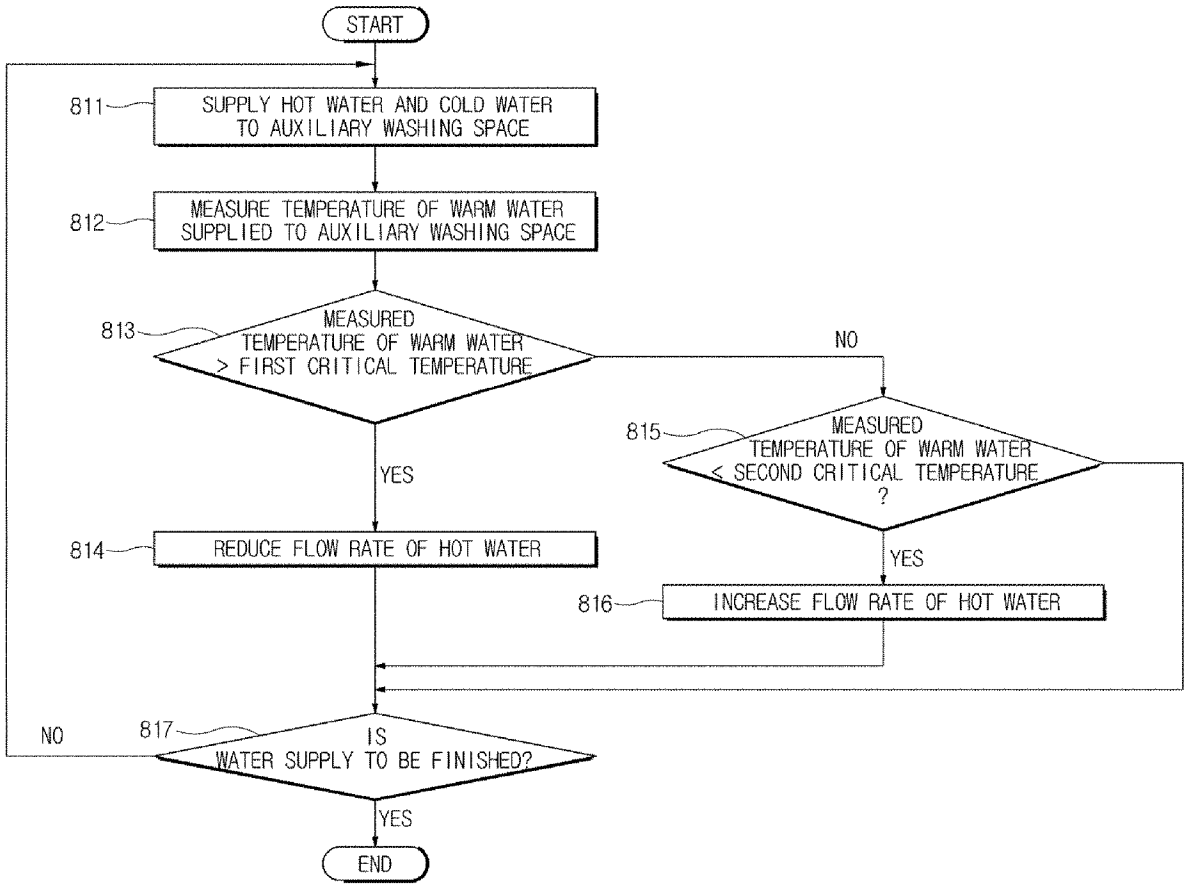
FIG. 34 is a flowchart illustrating still another example of controlling the warm water supply of the washing machine in accordance with one embodiment of the present disclosure.

FIG. 34 is a flowchart illustrating still another example of controlling of the warm water supply of the washing machine in accordance with one embodiment of the present disclosure.

Referring to FIG. 34, the washing machine 1 supplies hot water and cold water to the auxiliary washing space 120*a* (S811).

The washing machine 1 measures a temperature of the warm supplied to the auxiliary washing space 120*a* (S812).

The washing machine 1 determines whether the measured temperature of the warm water is higher than a first critical temperature (S813).

When the measured temperature of the warm water is higher than the first critical temperature, the washing machine 1 reduces the flow rate of the hot water to be supplied to the auxiliary washing space 120*a* (S814). In detail, when the first hot water valve 312*a* is a proportional control valve with a controllable opening degree, the flow rate of the hot water to be supplied to the auxiliary washing unit 120 may be reduced by reducing the opening degree of the first hot water valve 312*a*.

Also, as shown in FIG. 22, when the hot water distributing device 310 includes a plurality of valves for supplying hot water to the auxiliary washing unit 120, a flow rate of the hot water to be supplied to the auxiliary washing unit 120 may be reduced by controlling opening and closing of the plurality of valves.

Meanwhile, when the measured temperature of the warm water is the first critical temperature or lower (YES in S813), the washing machine 1 determines whether the measured temperature of the warm water is lower than a second critical temperature (S816).

When the measured temperature of the warm water is higher than the second critical temperature (NO in S815), the washing machine 1 determines whether to finish water supply without controlling a flow rate (S817).

On the contrary, when the measured temperature of the warm water is lower than the second critical temperature (YES in S815), the washing machine 1 increases the flow rate of the hot water to be supplied to the auxiliary washing space 120*a* (S816). In detail, when the first hot water valve 312*a* is a proportional control valve, the flow rate of the hot water to be supplied to the auxiliary washing unit 120 may be increased by increasing the opening degree of the first hot water valve 312*a*.

Also, as shown in FIG. 23, when the hot water distributing device 310 includes a plurality of hot water valves for supplying hot water to the auxiliary washing unit 120, the flow rate of the hot water to be supplied to the auxiliary washing unit 120 may be increased by controlling opening and closing of the plurality of hot water valves.

When the controlling of the flow rate is finished, the washing machine 1 determines whether to finish water supply (S817). Here, the end of the water supply may be determined depending on preset conditions. For example, the water supply may be finished when the user stops inputting a command for warm water supply or when a predetermined time passes after the user inputs the warm water supply command.

Figure 35:
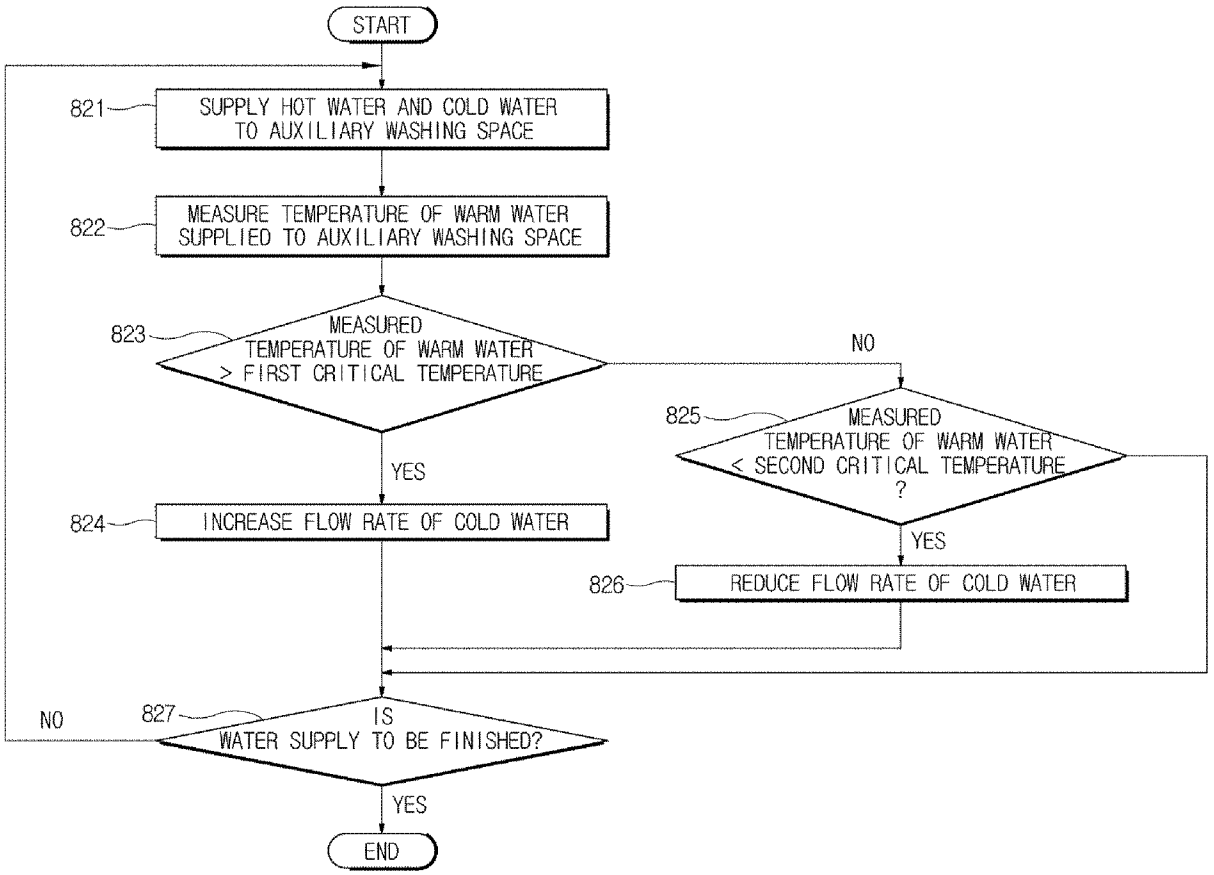
FIG. 35 is a flowchart illustrating yet another example of controlling the warm water supply of the washing machine in accordance with one embodiment of the present disclosure.

FIG. 35 is a flowchart illustrating yet another example of controlling the warm water supply of the washing machine in accordance with one embodiment of the present disclosure.

Referring to FIG. 35, the washing machine 1 supplies hot water and cold water to the auxiliary washing space 120*a* (S821).

The washing machine 1 measures a temperature of warm water supplied to the auxiliary washing space 120*a* (S822).

The washing machine 1 determines whether the measured temperature of the warm water is higher than a first critical temperature (S823).

When the measured temperature of the warm water is higher than the first critical temperature, the washing machine 1 increases a flow rate of the cold water to be supplied to the auxiliary washing space 120*a* (S824). In detail, when the first cold water valve 322*a* is a proportional control valve with a controllable opening degree, the flow rate of the cold water to be supplied to the auxiliary washing unit 120 may be increased by increasing the opening degree of the first cold water valve 322*a*.

Also, when the cold water distributing device 320 includes a plurality of cold water valves for supplying cold water to the auxiliary washing unit 120, the flow rate of the cold water to be supplied to the auxiliary washing unit 120 may be increased by controlling opening and closing of the plurality of cold water valves.

Meanwhile, when the measured temperature of the warm water is lower than the first critical temperature, the washing machine 1 determines whether the measured temperature of the warm water is lower than a second critical temperature (S825).

When the measured temperature of the warm water is higher than the second critical temperature, the washing machine 1 determines whether to finish water supply (S827).

On the contrary, when the measured temperature of the warm water is the second critical temperature or less, the washing machine 1 reduces the flow rate of the cold water to be supplied to the auxiliary washing space 120*a* (S826). In detail, when the first cold water valve 322*a* is controllable with an opening degree, the flow rate of the cold water to be supplied to the auxiliary washing unit 120 may be reduced by reducing the opening degree of the first cold water valve 322*a*.

Also, when the cold water distributing device 320 includes a plurality of cold water valves for supplying cold water to the auxiliary washing unit 120, the flow rate of the cold water to be supplied to the auxiliary washing unit 120 may be reduced by controlling opening and closing of the plurality of cold water valves.

When the controlling of the flow rate is finished, the washing machine 1 determines whether to finish water supply (S827). Here, the end of the water supply may be determined depending on preset conditions. For example, the water supply may be finished when the user stops inputting a command for warm water supply or when a predetermined time passes after the user inputs the warm water supply command.

Meanwhile, although the washing machine 1 controls a flow rate of hot water in FIG. 33 and controls a flow rate of cold water in FIG. 34, the washing machine 1 may control both the flow rate of the hot water and the flow rate of the cold water at the same time.

As is apparent from the above description, the washing machine and the method of controlling the same in accordance with one embodiment of the present disclosure can supply warm water to an auxiliary washing unit.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A washing machine comprising:

a body which includes an opening;

at least one tub which provides a main washing space into which laundry is receivable through the opening to be main washed by the washing machine;

an auxiliary washing unit which forms an auxiliary washing space with an open top when mounted on the body and is thereby configured to contain water supplied to the auxiliary washing space and to hold laundry to be hand washed with the contained water;

a mixing device;

a hot water distributing device selectively configurable to be in a configuration selected from a group including a first hot water distributing device configuration, a second hot water distributing device configuration and a third hot water distributing device configuration, to distribute hot water which flows in from outside of the washing machine so that when the hot water distributing device is configured to be in the first hot water distributing device configuration, the hot water is supplied to the mixing device without being supplied to the main washing space, when the hot water distributing device is configured to be in the second hot water distributing device configuration, the hot water is supplied to the main washing space without being supplied to the mixing device, and when the hot water distributing device is configured to be in the third hot water distributing device configuration, the hot water is supplied to both the mixing device and the main washing space; and a cold water distributing device selectively configurable to be in a configuration selected from a group including a first cold water distributing device configuration, a second cold water distributing device configuration and a third cold water distributing device configuration, to distribute cold water which flows in from the outside of the washing machine so that when the cold water distributing device is configured to be in the first cold water distributing device configuration, the cold water is supplied to the mixing device without being supplied to the main washing space, when the cold water distributing device is configured to be in the second cold water distributing device configuration, the cold water is supplied to the main washing space without being supplied to the mixing device, and when the cold water distributing device is configured to be in the third cold water distributing device configuration, the cold water is supplied to both the mixing device and the main washing space, the mixing device being configured so that so that, when the hot water is supplied to the mixing device without the cold water being supplied to the mixing device, the hot water is supplied to the auxiliary washing space through the mixing device, when the cold water is supplied to the mixing device without the hot water being supplied to the mixing device, the cold water is supplied to the auxiliary washing space through the mixing device, and when both the hot water and the cold water are supplied to the mixing device, the mixing device generates warm water by mixing the hot water and the cold water, and the generated warm water is supplied to the auxiliary washing space; and at least one processor which performs control to selectively configure the hot water distribution device to be in the configuration selected from the group including the first hot water distributing device configuration, the second hot water distributing device configuration and the third hot water distributing device configuration, and to selectively configure the cold water distributing device to be in the configuration selected from the group including the first cold water distributing device configuration, the second cold water distributing device configuration and the third cold water distributing device configuration.

2. The washing machine of claim 1, further comprising:

a supply device which supplies the warm water generated by the mixing device to the auxiliary washing space.

3. The washing machine of claim 1, wherein the at least one processor controls the distribution of the hot water to stop supplying the hot water when a temperature of the warm water supplied to the auxiliary washing space is a preset first critical temperature or higher.

4. The washing machine of claim 3, wherein the at least one processor controls the distribution of the hot water to resume supplying the hot water when the temperature of the warm water supplied to the auxiliary washing space is a preset second critical temperature or lower.

5. The washing machine of claim 3, further comprising:

a temperature sensor to measure the temperature of the warm water to be supplied to the auxiliary washing space.

6. The washing machine of claim 1, wherein the at least one processor controls a temperature of warm water to be supplied to the auxiliary washing space by controlling the distribution of the hot water by the hot water distributing device.

7. The washing machine of claim 6, wherein the hot water distributing device comprises at least one hot water valve to distribute the hot water, and the at least one processor controls the temperature of the warm water by controlling opening and closing of the at least one hot water valve.

8. The washing machine of claim 6, wherein the hot water distributing device comprises at least one proportional control valve to distribute the hot water, and the at least one processor controls the temperature of the warm water by controlling an opening degree of the proportional control valve.

9. The washing machine of claim 1, wherein the at least one processor controls a temperature of warm water to be supplied to the auxiliary washing space by controlling the distribution of the cold water by the cold water distributing device.

* * * * *